US009845994B2

(12) United States Patent
Jindou et al.

(10) Patent No.: US 9,845,994 B2
(45) Date of Patent: Dec. 19, 2017

(54) HEAT EXCHANGER CONFIGURED TO ACCELERATE DISCHARGE OF LIQUID REFRIGERANT FROM LOWEST HEAT EXCHANGE SECTION

(71) Applicant: DAIKIN INDUSTRIES, LTD., Osaka-shi, Osaka (JP)

(72) Inventors: Masanori Jindou, Osaka (JP); Yoshio Oritani, Osaka (JP); Takuya Kazusa, Osaka (JP); Yoshimasa Kikuchi, Osaka (JP); Shun Yoshioka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 499 days.

(21) Appl. No.: 14/396,400

(22) PCT Filed: Apr. 25, 2013

(86) PCT No.: PCT/JP2013/002819

§ 371 (c)(1),
(2) Date: Oct. 23, 2014

(87) PCT Pub. No.: WO2013/161311

PCT Pub. Date: Oct. 31, 2013

(65) Prior Publication Data

US 2015/0083377 A1 Mar. 26, 2015

(30) Foreign Application Priority Data

Apr. 27, 2012 (JP) ..... 2012-103170

(51) Int. Cl.
*F28F 9/26* (2006.01)
*F28F 7/00* (2006.01)
(Continued)

(52) U.S. Cl.
CPC ..... *F28D 1/05375* (2013.01); *F25B 39/022* (2013.01); *F28D 1/0417* (2013.01);
(Continued)

(58) Field of Classification Search
CPC ..... F28D 1/05325; F28D 1/05358; F28D 1/0417; F28D 1/05383; F28D 1/05391; F28D 1/05341; F28F 9/028
(Continued)

(56) References Cited

U.S. PATENT DOCUMENTS 4,121,656 A * 10/1978 Huber ..... F28F 9/0212 165/110
5,157,944 A 10/1992 Hughes et al.
(Continued)

FOREIGN PATENT DOCUMENTS

CN 1337552 A 2/2002
EP 2778595 A1 9/2014
(Continued)

OTHER PUBLICATIONS

International Search Report issued in PCT/JP2013/002819, dated Jul. 16, 2013.

*Primary Examiner* — Len Tran
*Assistant Examiner* — Paul Alvare
(74) *Attorney, Agent, or Firm* — Birch, Stewart, Kolasch & Birch, LLP

(57) ABSTRACT

A heat exchanger includes a plurality of principal heat exchange sections and auxiliary heat exchange sections. Each of the auxiliary heat exchange sections is in series connection to a corresponding one of the principal heat exchange sections. The number of the flat tubes constituting each of the heat exchange sections is compared to the number of the flat tubes constituting a corresponding one of the auxiliary heat exchange sections, creating a tube number ratio, wherein the first principal heat exchange section, which is lowermost, has the smallest tube number ratio. Consequently, discharge of liquid refrigerant from a lower portion of the first principal heat exchange section is accelerated during defrosting, thereby shortening the time required for defrosting.

6 Claims, 18 Drawing Sheets

(51) Int. Cl.

| | |
|---|---|
| ***F28F 9/02*** | (2006.01) |
| ***F28D 7/06*** | (2006.01) |
| ***F28D 1/053*** | (2006.01) |
| ***F25B 39/02*** | (2006.01) |
| ***F28F 17/00*** | (2006.01) |
| ***F28D 1/04*** | (2006.01) |
| ***F28F 9/22*** | (2006.01) |
| *F25B 47/02* | (2006.01) |
| *F28F 1/02* | (2006.01) |
| *F28F 1/32* | (2006.01) |

(52) U.S. Cl.
CPC ..... *F28D 1/0443* (2013.01); *F28F 9/0204* (2013.01); *F28F 9/22* (2013.01); *F28F 17/00* (2013.01); *F25B 47/025* (2013.01); *F28D 1/05325* (2013.01); *F28D 1/05341* (2013.01); *F28D 1/05358* (2013.01); *F28D 1/05391* (2013.01); *F28F 1/022* (2013.01); *F28F 1/325* (2013.01)

(58) Field of Classification Search
USPC ..... 165/139, 144, 174, 176; 62/525, 526
See application file for complete search history.

(56) References Cited

U.S. PATENT DOCUMENTS 5,203,407 A * 4/1993 Nagasaka ..... F28D 1/05375 165/174
5,482,112 A * 1/1996 Sasaki ..... B21C 37/22 165/110
5,988,267 A * 11/1999 Park ..... F25B 39/04 165/110
8,250,874 B2 * 8/2012 Ikegami ..... B60H 1/00335 165/100
8,439,104 B2 * 5/2013 de la Cruz ..... F28D 1/05391 165/146
8,839,847 B2 * 9/2014 Suzuki ..... F25B 39/04 165/110
2003/0217567 A1 * 11/2003 Oh ..... F25B 39/04 62/507
2013/0292098 A1 11/2013 Jindou et al.

FOREIGN PATENT DOCUMENTS

| | | | |
|---|---|---|---|
| JP | 2-225999 | A | 9/1990 |
| JP | 4-174297 | A | 6/1992 |
| JP | 5-118706 | A | 5/1993 |
| JP | 5-312492 | A | 11/1993 |
| JP | 8-193771 | A | 7/1996 |
| JP | 11-351784 | A | 12/1999 |
| JP | 2002-139295 | A | 5/2002 |
| JP | 2003-343943 | A | 12/2003 |
| JP | 2004-069228 | A | 3/2004 |
| JP | 2005-003223 | A | 1/2005 |
| JP | 2006-105545 | A | 4/2006 |
| JP | 2011-145029 | A | 7/2011 |
| WO | WO 2012/098912 | A1 | 7/2012 |
| WO | WO 2013/076993 | A1 | 5/2013 |

* cited by examiner

CROSS SECTION TAKEN ALONG LINE B-B

CROSS SECTION TAKEN ALONG LINE C-C

CROSS SECTION TAKEN ALONG LINE D-D

HEAT EXCHANGER CONFIGURED TO ACCELERATE DISCHARGE OF LIQUID REFRIGERANT FROM LOWEST HEAT EXCHANGE SECTION

TECHNICAL FIELD

The present invention relates to heat exchangers including a plurality of flat tubes and a pair of header-collecting pipes, connected to a refrigerant circuit performing a refrigerating cycle, and causing a refrigerant to exchange heat with air.

Heat exchangers including a plurality of flat tubes and a pair of header-collecting pipes have been conventionally known. For example, Patent Documents 1 and 2 each disclose a heat exchanger of this type. The heat exchanger of each of the patent documents includes first and second header-collecting pipes which are installed in an upright position on the right and left sides of the heat exchanger, respectively, and a plurality of flat tubes which extend from the first header-collecting pipe to the second header-collecting pipe. The heat exchanger of each of the patent documents causes a refrigerant flowing inside the flat tubes to exchange heat with air flowing outside the flat tubes. The heat exchanger of this type is connected to a refrigerant circuit performing a refrigerating cycle, and functions as an evaporator or a condenser.

CITATION LIST

Patent Document

PATENT DOCUMENT 1: Japanese Unexamined Patent Publication No. 2005-003223

PATENT DOCUMENT 2: Japanese Unexamined Patent Publication No. 2006-105545

SUMMARY OF THE INVENTION

Technical Problem

Meanwhile, when a heat exchanger functions as an evaporator, it sometimes happens that moisture contained in air turns into frost forming on the heat exchanger. The frost on the heat exchanger impedes heat exchange between air and the refrigerant. To address this, the heat exchanger is configured to perform defrosting in which the frost on the heat exchanger is melted by means of a high-pressure gaseous refrigerant. Depending on the structure of a heat exchanger, it may disadvantageously require a considerably long time to melt all of frost on the heat exchanger. Here, this problem is detailed with reference to FIG. 18.

FIG. 18 illustrates a heat exchanger (900) including a plurality of flat tubes, header-collecting pipes (903, 906) connected to the flat tubes, and fins. In FIG. 18, the flat tubes and the fins are not shown.

The heat exchanger (900) is partitioned into three principal heat exchange sections (901*a*-901*c*) and three auxiliary heat exchange sections (902*a*-902*c*). The first header-collecting pipe (903) includes an upper communicating space (904) with which the flat tubes of the principal heat exchange sections (901*a*-901*c*) communicate, and a lower communicating space (905) with which the flat tubes of the auxiliary heat exchange sections (902*a*-902*c*) communicate. The second header-collecting pipe (906) includes three principal subspaces (907*a*, 907*b*, 907*c*) which correspond to the principal heat exchange sections (901*a*-901*c*) and three auxiliary subspaces (908*a*, 908*b*, 908*c*) which correspond to the auxiliary heat exchange sections (902*a*-902*c*). In the heat exchanger (900), the first principal heat exchange section (901*a*) is connected in series to the third auxiliary heat exchange section (902*c*), the second principal heat exchange section (901*b*) is connected in series to the second auxiliary heat exchange section (902*b*), and the third principal heat exchange section (901*c*) is connected in series to the first auxiliary heat exchange section (902*a*).

When the heat exchanger (900) functions as an evaporator, a refrigerant having flowed into the lower communicating space (905) of the first header-collecting pipe (903) passes through the auxiliary heat exchange sections (902*a*-902*c*) and the principal heat exchange sections (901*a*-901*c*) sequentially. The refrigerant absorbs heat and evaporates while passing through the auxiliary and principal heat exchange sections, and then, flows into the upper communicating space (904) of the first header-collecting pipe (903). When the heat exchanger (900) is functioning as the evaporator, frost sometimes forms on the surface of the heat exchanger (900). As illustrated in (a) of FIG. 18, in a state where frost has formed almost entirely on the heat exchanger (900), the refrigerant absorbs a very small amount of heat, and consequently, the major portion of the heat exchanger (900) becomes filled with the liquid refrigerant.

When the defrosting starts, the high-temperature and high-pressure gaseous refrigerant discharged from a compressor flows into the upper communicating space (904) of the first header-collecting pipe (903). The gaseous refrigerant then flows from the upper communicating space (904) into the flat tubes of the principal heat exchange sections (901*a*-901*c*), where the gaseous refrigerant dissipates heat to the frost, and condenses. The frost on the heat exchanger (900) is heated and melted by the gaseous refrigerant. In the heat exchanger (900), the gaseous refrigerant passes through portions where the frost has already been melted nearly without condensing, and then, dissipates heat and condenses when it reaches portions where the frost remains. Consequently, in the heat exchanger (900) performing the defrosting, portions where the liquid refrigerant is present roughly coincide with portions where the not-yet-melted frost remains. In FIG. 18, the regions where the liquid refrigerant is present are marked with dots.

As illustrated in (b)-(e) of FIG. 18, during the defrosting, in the principal heat exchange sections (901*a*-901*c*) of the heat exchanger (900), the regions where the gaseous refrigerant is present (i.e., the regions where the frost has been melted) gradually expand from the first header-collecting pipe (903) toward the second header-collecting pipe (906). As the regions expand, the heat exchanger enters a state illustrated in (b) and (c) of FIG. 18, in which only the gaseous refrigerant is present in an upper portion of the upper communicating space (904) of the first header-collecting pipe (903) whereas the liquid refrigerant remains in a bottom portion of the communicating space (904). Under this state, in the second principal heat exchange sections (901*b*) and the third principal heat exchange sections (901*c*) that are upper-located principal heat exchange sections, the gaseous refrigerant has already begun flowing through all of the flat tubes. On the other hand, in the first principal heat exchange sections (901*a*) that is the lowermost principal heat exchange section, the gaseous refrigerant flows into upper located ones of the flat tubes only, and lower located ones of the flat tubes remain filled with the liquid refrigerant. Consequently, in the first principal heat exchange section (901*a*), progress of the defrosting is slower as compared to the progress in the second principal heat exchange section (901*b*) and the third principal heat exchange sections (901*c*).

Further, (d) of FIG. 18 illustrates a state where little liquid refrigerant is present in the second principal heat exchange section (901*b*) and the third principal heat exchange section (901*c*). Under this state, a large proportion of the gaseous refrigerant having been introduced in the upper communicating space (904) flows into the second principal heat exchange section (901*b*) and the third principal heat exchange section (901*c*), and a flow rate at which the gaseous refrigerant flows into the first principal heat exchange section (901*a*) where a large amount of the liquid refrigerant remains is reduced. Consequently, force with which the gaseous refrigerant having entered the upper communicating space (904) pushes the liquid refrigerant that is present in a lower portion of the first principal heat exchange section (901*a*) (i.e., in lowermost ones of the flat tubes of the first principal heat exchange section (901*a*)) is weakened, which results in that the progress of the defrosting in the first principal heat exchange section (901*a*) is further slowed.

Nevertheless, as the amount of the liquid refrigerant present in the first principal subspace (907*a*) of the second header-collecting pipe (906) gradually decreases, the amount of the liquid refrigerant present in the upper communicating space (904) of the first header-collecting pipe (903) also gradually decreases. Consequently, in the first principal heat exchange section (901*a*), the portion where the gaseous refrigerant flows gradually expands.

The heat exchanger then enters a state illustrated in (e) of FIG. 18 where the liquid refrigerant has been completely expelled from the first principal subspace (907*a*) of the second header-collecting pipe (906). Under this state, in the first principal heat exchange section (901*a*), almost all of the gaseous refrigerant flows into upper located ones of the flat tubes where the frost has already been melted whereas a slight amount of the gaseous refrigerant is allowed to flow into the lowermost flat tubes where the liquid refrigerant remains. Accordingly, the force with which the liquid refrigerant remaining in the lowermost flat tubes is pushed toward the second header-collecting pipe (906) becomes very weak. Consequently, as illustrated in (f) of FIG. 18, even when defrosting of the third auxiliary heat exchange section (902*c*) has been completed, the liquid refrigerant is still left in the lowermost flat tubes of the first principal heat exchange section (901*a*), thereby allowing not-yet-melted frost to remain in the portion corresponding to the lowermost flat tubes.

As a matter of course, it is possible to melt the frost in the lowermost portion of the first principal heat exchange section (901*a*) by setting the duration of the defrosting to a sufficiently long time (e.g. 15 minutes or more). It is impractical, however, to spend such a long time in performing the defrosting. Thus, according to conventional techniques, it may be impossible to complete defrosting within an appropriate period of time.

It is therefore an object of the present invention to shorten the time required to defrost a heat exchanger including flat tubes and header-collecting pipes.

Solution to the Problem

A first aspect of the present invention relates to a heat exchanger comprising: a plurality of flat tubes (33); a first header-collecting pipe (60) connected to an end of each of the flat tubes (33); a second header-collecting pipe (70) connected to the other end of each of the flat tubes (33); and a plurality of fins (36) joined to the flat tubes (33), where the heat exchanger is provided in a refrigerant circuit (20) which is configured to perform a refrigerating cycle, and causes a refrigerant to exchange heat with air, wherein the first header-collecting pipe (60) and the second header-collecting pipe (70) are in an upright position, a plurality of heat exchange sections (51*a*-51*c*) each of which is constituted by adjacent ones the flat tubes (33) are arranged one above the other, the first header-collecting pipe (60) includes therein one communicating space (61) which communicates with the flat tubes (33) of all of the heat exchange sections (51*a*-51*c*), the second header-collecting pipe (70) includes therein subspaces (71*a*-71*c*) which correspond to the heat exchange sections (51*a*-51*c*) on a one-by-one basis and each communicate with the flat tubes (33) constituting a corresponding one of the heat exchange sections (51*a*-51*c*), and the heat exchanger further includes a discharge accelerator (100) which accelerates discharge of the refrigerant in a liquid state from a lower portion of the heat exchange section (51*a*) which is the lowermost heat exchange section during defrosting in which the refrigerant in a high-pressure gas state is introduced from the communicating space (61) to the flat tubes (33) in order to melt frost having formed on the fins (36).

The heat exchanger (23) of the first aspect is provided in the refrigerant circuit (20) configured to perform a refrigerating cycle. The refrigerant circulating through the refrigerant circuit (20) flows through flat tubes (33) from one to the other of the first header-collecting pipe (60) and the second header-collecting pipe (70). While flowing through the flat tubes (33), the refrigerant exchange heat with air passing between the plurality of fins (36). When the heat exchanger (23) is functioning as an evaporator, it sometimes happens that moisture contained in air turns into frost forming on the fins (36). The frost on the fins (36) impedes heat exchange between the refrigerant and air. Consequently, when the frost has formed on the almost entire heat exchanger (23), the refrigerant can absorb a slight amount of heat from air, which may allow the refrigerant in a liquid state to remain present also in the communicating space (61) of the first header-collecting pipe (60).

According to the first aspect, during the defrosting for melting the frost on the fins (36), the refrigerant in a high-pressure gas state flows into the communicating space (61) of the first header-collecting pipe (60). As the refrigerant in a high-pressure gas state flows into the communicating space (61) of the first header-collecting pipe (60), the liquid level of the refrigerant in a liquid state present in the communicating space (61) is gradually lowered, and the refrigerant in a high-pressure gas state is allowed to enter some of the flat tubes (33) opening above the liquid level. The frost on the fins (36) is heated and melted by the refrigerant in a high-pressure gas state having flowed into the flat tubes (33).

The heat exchanger (23) of the first aspect is equipped with the discharge accelerator (100). Consequently, when the heat exchanger (23) is performing the defrosting, discharge of the refrigerant in a liquid state from the lower portion of the heat exchange section (51*a*) that is the lowermost heat exchange section (i.e. from the lowermost ones of the flat tubes (33) of the heat exchange section (51*a*)) is accelerated, and the amount of the refrigerant in a liquid state present in the lower portion of the heat exchange section (51*a*) decreases speedily. When the liquid level of the refrigerant in a liquid state present in the communicating space (61) becomes lower than the lowermost one of the flat tubes (33) of the heat exchange section (51*a*) that is the lowermost heat exchange section, the refrigerant in a high-pressure gas state can flow into all of the flat tubes (33) constituting the heat exchange sections (51*a*-51*c*).

A second aspect of the present invention relates to the heat exchanger of the first aspect, wherein the flat tubes (33) constitute auxiliary heat exchange sections (52*a*-52*c*) which correspond to the heat exchange sections (51*a*-51*c*) on a one-by-one basis, the flat tubes (33) constituting the auxiliary heat exchange sections (52*a*-52*c*) are smaller in number than the flat tubes (33) constituting the heat exchange sections (51*a*-51*c*), and the auxiliary heat exchange sections (52*a*-52*c*) are each in series connection to a corresponding one of the heat exchange sections (51*a*-51*c*).

In the heat exchanger (23) according to the second aspect, the number of the heat exchange sections (51*a*-51*c*) is the same as the number of the auxiliary heat exchange sections (52*a*-52*c*). The auxiliary heat exchange sections (52*a*-52*c*) are each in series connection to a corresponding one of the heat exchange sections (51*a*-51*c*). During the defrosting, the refrigerant having passed through the flat tubes (33) of each of the heat exchange sections (51*a*-51*c*) flows into the flat tubes (33) of a corresponding one of the auxiliary heat exchange sections (52*a*-52*c*).

A third aspect of the present invention relates to the heat exchanger of the second aspect, wherein tube number ratios are obtained by dividing the number of the flat tubes (33) constituting each of the heat exchange sections (51*a*-51*c*) by the number of the flat tubes (33) constituting a corresponding one of the auxiliary heat exchange sections (52*a*-52*c*), the tube number ratio of the heat exchange section (51*a*) that is the lowermost heat exchange section is smallest of the tube number ratios, and the heat exchange section (51*a*) that is the lowermost heat exchange section and the auxiliary heat exchange section (52*c*) corresponding to the heat exchange section (51*a*) form the discharge accelerator (100).

According to the third aspect, the tube number ratios are obtained by dividing "the number of the flat tubes (33) constituting each of the heat exchange sections (51*a*-51*c*)" by "the number of the flat tubes (33) constituting a corresponding one of the auxiliary heat exchange sections (52*a*-52*c*)." The number of the flat tubes (33) of each of the auxiliary heat exchange sections (52*a*-52*c*) is less than the number of the flat tubes (33) of the corresponding one of the heat exchange sections (51*a*-51*c*). Therefore, each tube number ratio is necessarily greater than 1. Further, according to this aspect, the tube number ratio between the heat exchange section (51*a*) that is the lowermost heat exchange section and the auxiliary heat exchange section (52*c*) which corresponds to the heat exchange section (51*a*) is smaller than the tube number ratio between each of the other heat exchange sections (51*b*, 51*c*) and a corresponding one of the auxiliary heat exchange sections (52*a*, 52*b*).

In the heat exchanger (23) of the third aspect, when each of the heat exchange sections (51*a*-51*c*) is constituted by the same number of the flat tubes (33) for example, the number of the flat tubes (33) of the auxiliary heat exchange section (52*c*) corresponding to the heat exchange section (51*a*) that is the lowermost heat exchange section is greater than the number of the flat tubes (33) of each of the other auxiliary heat exchange sections (52*a*, 52*b*). Accordingly, during the defrosting, the flow rate at which the refrigerant in a gas state flows into the heat exchange section (51*a*) corresponding to the auxiliary heat exchange section (52*c*) becomes greater as compared to a case where each of the auxiliary heat exchange sections (52*a*-52*c*) is constituted by the same number of the flat tubes (33). Consequently, the flow rate at which the refrigerant in a gas state flows into each of the flat tubes (33) of the lowermost heat exchange section (51*a*) is increased, and it becomes easy to push and move, toward the second header-collecting pipe (70), the refrigerant in a liquid state present in lowermost ones of the flat tubes (33) of the heat exchange section (51*a*) and a bottom portion of the communicating space (61) of the first header-collecting pipe (60) communicating with the lowermost flat tubes (33). Thus, discharge of the refrigerant in a liquid state from the lower portion of the lowermost heat exchange section (51*a*) is accelerated.

Further, in the heat exchanger (23) of the third aspect, when the auxiliary heat exchange sections (52*a*-52*c*) are constituted by equivalent numbers of the flat tubes (33), the number of the flat tubes (33) of the heat exchange section (51*a*) that is the lowermost heat exchange section is less than that of each of the other heat exchange sections (51*b*, 51*c*). In this case, the refrigerant in a gas state flows into each of the heat exchange sections (51*a*-51*c*) at nearly the same flow rate. Consequently, the flow rate at which the refrigerant in a gas state flows into each of the flat tubes (33) of the lowermost heat exchange section (51*a*) is increased, and it becomes easy to push and move, toward the second header-collecting pipe (70), the refrigerant in a liquid state present in the lowermost ones of the flat tubes (33) of the heat exchange section (51*a*) and the bottom portion of the communicating space (61) of the first header-collecting pipe (60) communicating with the lowermost flat tubes (33). Thus, discharge of the refrigerant in a liquid state from the lower portion of the lowermost heat exchange section (51*a*) is accelerated.

A fourth aspect of the present invention relates to the heat exchanger of the third aspect, wherein the number of the flat tubes (33) constituting the auxiliary heat exchange section (52*c*) corresponding to the heat exchange section (51*a*) that is the lowermost heat exchange section is largest of the numbers of the flat tubes (33) constituting the auxiliary heat exchange sections (52*a*-52*c*).

According to the fourth aspect, the number of the flat tubes (33) of the auxiliary heat exchange section (52*c*) corresponding to the lowermost heat exchange section (51*a*) is greater than the number of the flat tubes (33) of each of the other auxiliary heat exchange sections (52*a*, 52*b*).

A fifth aspect of the present invention relates to the heat exchanger of any one of the second to fourth aspects, wherein all of the auxiliary heat exchange sections (52*a*-52*c*) are located below all of the heat exchange sections (51*a*-51*c*).

According to the fifth aspect, all of the auxiliary heat exchange sections (52*a*-52*c*) are located below the heat exchange section (51*a*) that is the lowermost heat exchange section. In the heat exchanger (23) performing the defrosting, the refrigerant having passed through the heat exchange sections (51*a*-51*c*) flows into the auxiliary heat exchange sections (52*a*-52*c*) located below the heat exchange sections (51*a*-51*c*).

A sixth aspect of the present invention relates to the heat exchanger of the fifth aspect, wherein the auxiliary heat exchange section (52*c*) corresponding to the heat exchange section (51*a*) that is the lowermost heat exchange section is an uppermost located one of all of the auxiliary heat exchange sections (52*a*-52*c*).

According to the sixth aspect, the auxiliary heat exchange section (52*c*) corresponding to the lowermost heat exchange section (51*a*) is located below the heat exchange section (51*a*) and above the other auxiliary heat exchange sections (52*a*, 52*b*).

Advantages of the Invention

As mentioned above, during the defrosting according to conventional techniques, a long period of time is required to discharge all of the refrigerant in a liquid state from the lower portion of the heat exchange section (51*a*) that is the lowermost heat exchange section. That is, according to conventional technique, the refrigerant in a liquid state is allowed to remain present for a long period in the lowermost ones of the flat tubes (33) of the lowermost heat exchange section (51*a*) and the bottom portion the communicating space (61) of the first header-collecting pipe (60) communicating with the lowermost flat tubes (33). Accordingly, as long as the refrigerant in a liquid state remains present in the bottom portion of the communicating space (61), the refrigerant in a high-pressure gas state is not allowed to enter ones of the flat tubes (33) above which the liquid level of the refrigerant in a liquid state is positioned. Consequently, it has conventionally been impossible to melt frost having formed near the flat tubes (33) above which the liquid level is positioned.

To address this problem, the heat exchanger (23) of the present invention is equipped with the discharge accelerator (100), and the amount of the refrigerant in a liquid state present in the lower portion of the heat exchange section (51*a*) that is the lowermost heat exchange section decreases quickly. Consequently, it is possible to shorten the time from the start of the defrosting to entering into a state where the refrigerant in a high-pressure gas state is allowed to flow into all of the flat tubes (33*a*) constituting the principal heat exchange sections (51*a*-51*c*). After the refrigerant in a high-pressure gas state has begun to flow into all of the flat tubes (33*a*) constituting the principal heat exchange sections (51*a*-51*c*), the frost is gradually melted in the entire principal heat exchange sections (51*a*-51*c*). Therefore, according to the present invention, it is possible to shorten the time required to defrost the portion where frost would be allowed to remain according to the conventional techniques (i.e., the lower portion of the heat exchange section (51*a*) that is the lowermost exchange section). As a result, the time required to defrost the entire outdoor heat exchanger (23) can be shortened.

According to the third aspect, the tube number ratios are obtained by dividing "the number of the flat tubes (33) constituting each of the heat exchange sections (51*a*-51*c*)" by "the number of the flat tubes (33) constituting a corresponding one of the auxiliary heat exchange sections (52*a*-52*c*)," and the tube number ratio between the heat exchange section (51*a*) that is the lowermost heat exchange section and the auxiliary heat exchange section (52*c*) that corresponds to heat exchange section (51*a*) is the smallest. Therefore, as described above, the flow rate at which the refrigerant in a gas state flows into each of the flat tubes (33) of the lowermost heat exchange section (51*a*) is increased, and it becomes easy to push and move, toward the second header-collecting pipe (70), the refrigerant in a liquid state present in the lowermost ones of the flat tubes (33) of the heat exchange section (51*a*) and the bottom portion of the communicating space (61) of the first header-collecting pipe (60) communicating with the lowermost flat tubes (33). Thus, discharge of the refrigerant in a liquid state from the lower portion of the lowermost heat exchange section (51*a*) is accelerated.

Thus, according to the third aspect, discharge of the refrigerant in a liquid state from the lower portion of the lowermost principal heat exchange section (51*a*) is accelerated by adjusting the numbers of flat tubes (33) constituting the principal heat exchange sections (51*a*-51*c*) and the auxiliary heat exchange sections (52*a*-52*c*). Therefore, according to this aspect, it is possible to shorten the time required to defrost the entire outdoor heat exchanger (23) without adding any new parts or members to the outdoor heat exchanger (23).

BRIEF DESCRIPTION OF THE DRAWINGS

FIG. 6A illustrates a portion of the cross-section taken along the line B-B in FIG. 5. FIG. 6B illustrates a cross-section taken along the line C-C in FIG. 6A. FIG. 6C illustrates a cross-section taken along the line D-D in FIG. 6A.

DESCRIPTION OF EMBODIMENTS

Embodiments of the present invention will be descried below in detail with reference to the drawings. The following embodiments and variations are merely preferred examples in nature, and are not intended to limit the scope, applications, and use of the present invention.

<<Embodiment 1>>

Embodiment 1 of the present invention is now described. A heat exchanger of this embodiment is an outdoor heat exchanger (23) provided in an air conditioner (10). The air conditioner (10) is described first, and thereafter, a detailed description of the outdoor heat exchanger (23) will be given.

—Air Conditioner—

Figure 1:
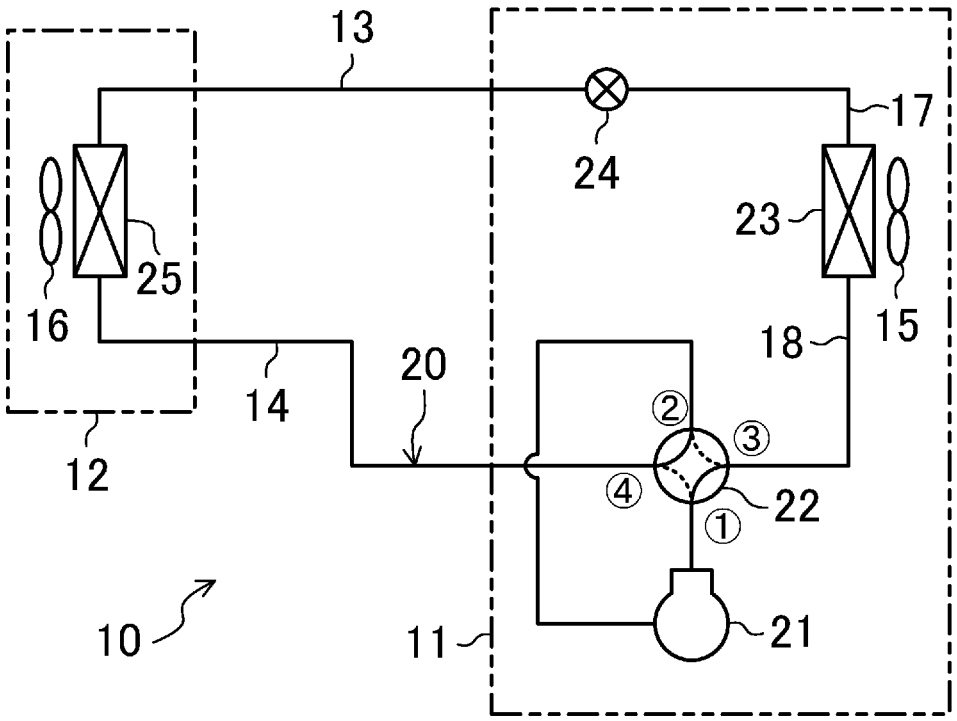
FIG. 1 is a circuit diagram schematically illustrating a configuration of an air conditioner including an outdoor heat exchanger of Embodiment 1.

First, the air conditioner (10) is described with reference to FIG. 1.

<Configuration of Air Conditioner>

The air conditioner (10) includes an outdoor unit (11) and an indoor unit (12). The outdoor unit (11) and the indoor unit (12) are connected to each other via a liquid communication pipe (13) and a gas communication pipe (14). In the air conditioner (10), the outdoor unit (11), the indoor unit (12), the liquid communication pipe (13), and the gas communication pipe (14) form a refrigerant circuit (20).

The refrigerant circuit (20) includes a compressor (21), a four-way switching valve (22), the outdoor heat exchanger (23), an expansion valve (24), and an indoor heat exchanger (25). The compressor (21), the four-way switching valve (22), the outdoor heat exchanger (23), and the expansion valve (24) are housed in the outdoor unit (11). The outdoor unit (11) is provided with an outdoor fan (15) configured to supply outdoor air to the outdoor heat exchanger (23). On the other hand, the indoor heat exchanger (25) is housed in the indoor unit (12). The indoor unit (12) is provided with an indoor fan (16) configured to supply indoor air to the indoor heat exchanger (25).

The refrigerant circuit (20) is a closed circuit filled with a refrigerant. In the refrigerant circuit (20), the compressor (21) has a discharge pipe connected to a first port of the four-way switching valve (22) and a suction pipe connected to a second port of the four-way switching valve (22). Further, in the refrigerant circuit (20), a third port of the four-way switching valve (22), the outdoor heat exchanger (23), the expansion valve (24), the indoor heat exchanger (25), and a fourth port of the four-way switching valve (22) are sequentially arranged.

The compressor (21) is a scroll-type or rotary-type hermetic compressor. The four-way switching valve (22) is switchable between a first state and a second state. In the first state (indicated by the solid lines in FIG. 1), the first port communicates with the third port and the second port communicates with the fourth port. In the second state (indicated by the broken lines in FIG. 1), the first port communicates with the fourth port and the second port communicates with the third port. The expansion valve (24) is a so-called electronic expansion valve.

The outdoor heat exchanger (23) causes outdoor air to exchange heat with the refrigerant. The outdoor heat exchanger (23) will be detailed later. On the other hand, the indoor heat exchanger (25) causes indoor air to exchange heat with the refrigerant. The indoor heat exchanger (25) is a so-called cross-fin type fin-and-tube heat exchanger including circular heat transfer tubes.

<Operation of Air Conditioner>

The air conditioner (10) selectively performs cooling operation, heating operation, and defrosting operation.

During the cooling operation and the heating operation, the outdoor fan (15) and the indoor fan (16) of the air conditioner (10) are in operation. The outdoor fan (15) supplies outdoor air to the outdoor heat exchanger (23), and the indoor fan (16) supplies indoor air to the indoor heat exchanger (25).

During the cooling operation, the refrigerant circuit (20) performs a refrigerating cycle with the four-way switching valve (22) maintained in the first state. In this state, the refrigerant circulates by passing through the outdoor heat exchanger (23), the expansion valve (24), and the indoor heat exchanger (25) in this order, and the outdoor heat exchanger (23) functions as a condenser whereas the indoor heat exchanger (25) functions as an evaporator. In the outdoor heat exchanger (23), the gaseous refrigerant having flowed from the compressor (21) dissipates heat into outdoor air to become condensed, and the condensed refrigerant flows out of the outdoor heat exchanger (23) toward the expansion valve (24). The indoor unit (12) blows air cooled in the indoor heat exchanger (25) into a room.

During the heating operation, the refrigerant circuit (20) performs a refrigerating cycle with the four-way switching valve (22) maintained in the second state. In this state, the refrigerant circulates by passing through the indoor heat exchanger (25), the expansion valve (24), and the outdoor heat exchanger (23) in this order, and the indoor heat exchanger (25) functions as a condenser whereas the outdoor heat exchanger (23) functions as an evaporator. The refrigerant having expanded upon passing through the expansion valve (24) and being in a gas-liquid two-phase state flows into the outdoor heat exchanger (23). In the outdoor heat exchanger (23), the refrigerant absorbs heat from outdoor air and evaporates, and then, flows out of the outdoor heat exchanger (23) toward the compressor (21). The indoor unit (12) blows air heated in the indoor heat exchanger (25) into the room.

During the heating operation in which the outdoor heat exchanger (23) functions as the evaporator, it sometimes happens that moisture contained in outdoor air turns into frost forming on the surface of the outdoor heat exchanger (23). The frost on the outdoor heat exchanger (23) impedes heat exchange between the refrigerant and outdoor air, and heating performance of the air conditioner (10) decreases. The air conditioner (10) temporarily suspends the heating operation to carry out the defrosting operation when defrosting start conditions which indicate that a certain amount or more of frost has formed on the outdoor heat exchanger (23) are satisfied.

During the defrosting operation, the outdoor fan (15) and the indoor fan (16) of the air conditioner (10) are out of operation. During the defrosting operation, in the refrigerant circuit (20), the four-way switching valve (22) is maintained in the first state and the compressor (21) is in operation. Further, the rotation speed of the compressor (21) is set to the lower limit value during the defrosting operation. In the refrigerant circuit (20), the refrigerant circulates in the same manner as the cooling operation, during the frosting operation. Specifically, the high-temperature and high-pressure gaseous refrigerant discharged from the compressor (21) is supplied to the outdoor heat exchanger (23). The frost on the outdoor heat exchanger (23) is heated and melted by the gaseous refrigerant. The refrigerant having passed through the outdoor heat exchanger (23) flows through the expansion valve (24) and the indoor heat exchanger (25) sequentially, and then, is sucked into and compressed by the compressor (21).

—Outdoor Heat Exchanger—

The outdoor heat exchanger (23) is now described with reference to FIGS. 2-7 as appropriate. Note that the number of flat tubes (33), the number of principal heat exchange sections (51*a*-51*c*), and the number of auxiliary heat exchange sections (52*a*-52*c*) are merely described as examples.

<Configuration of Outdoor Heat Exchanger>

Figure 2:
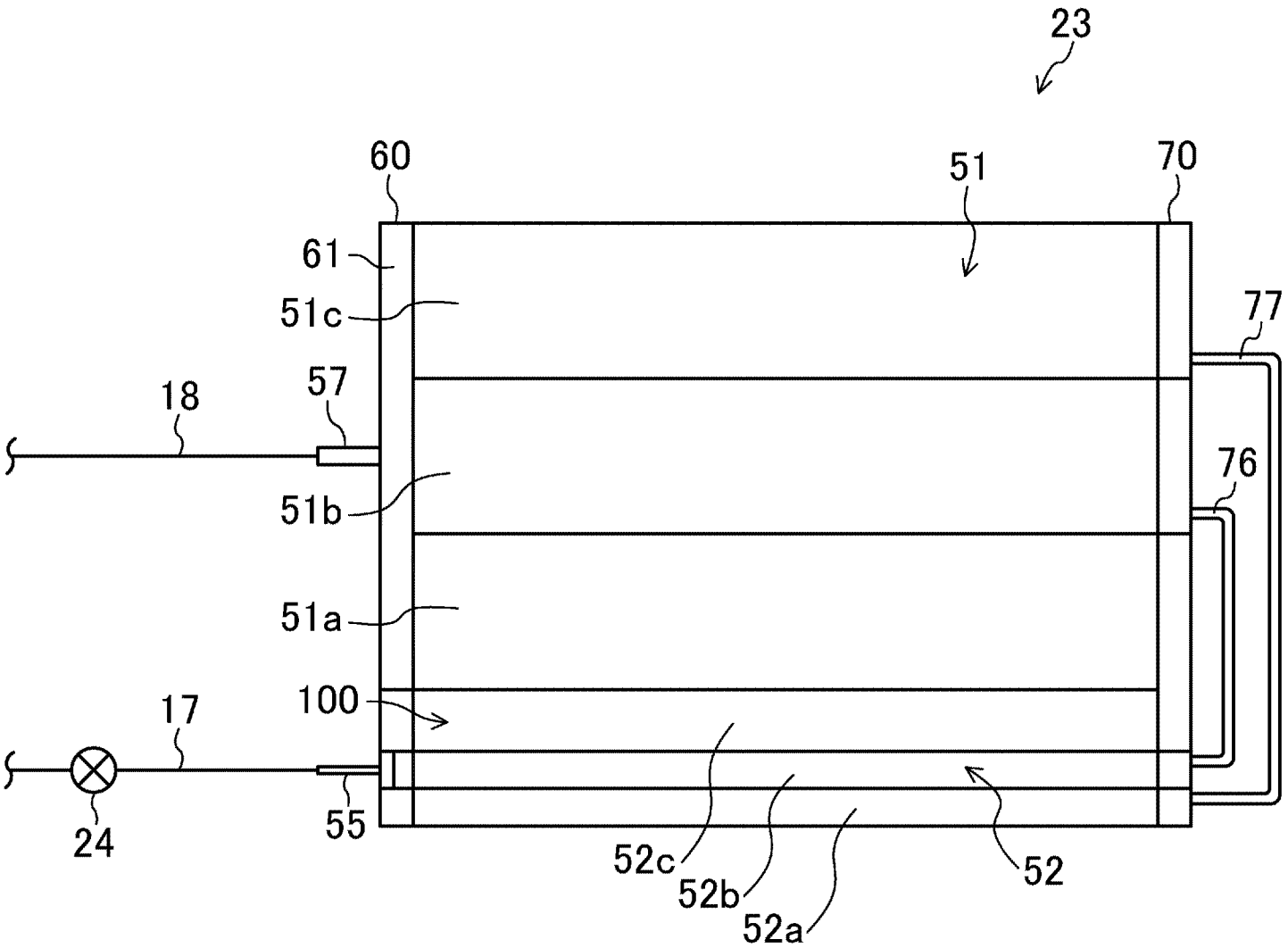
FIG. 2 is a front view schematically illustrating the configuration of the outdoor heat exchanger of Embodiment 1.
Figure 3:
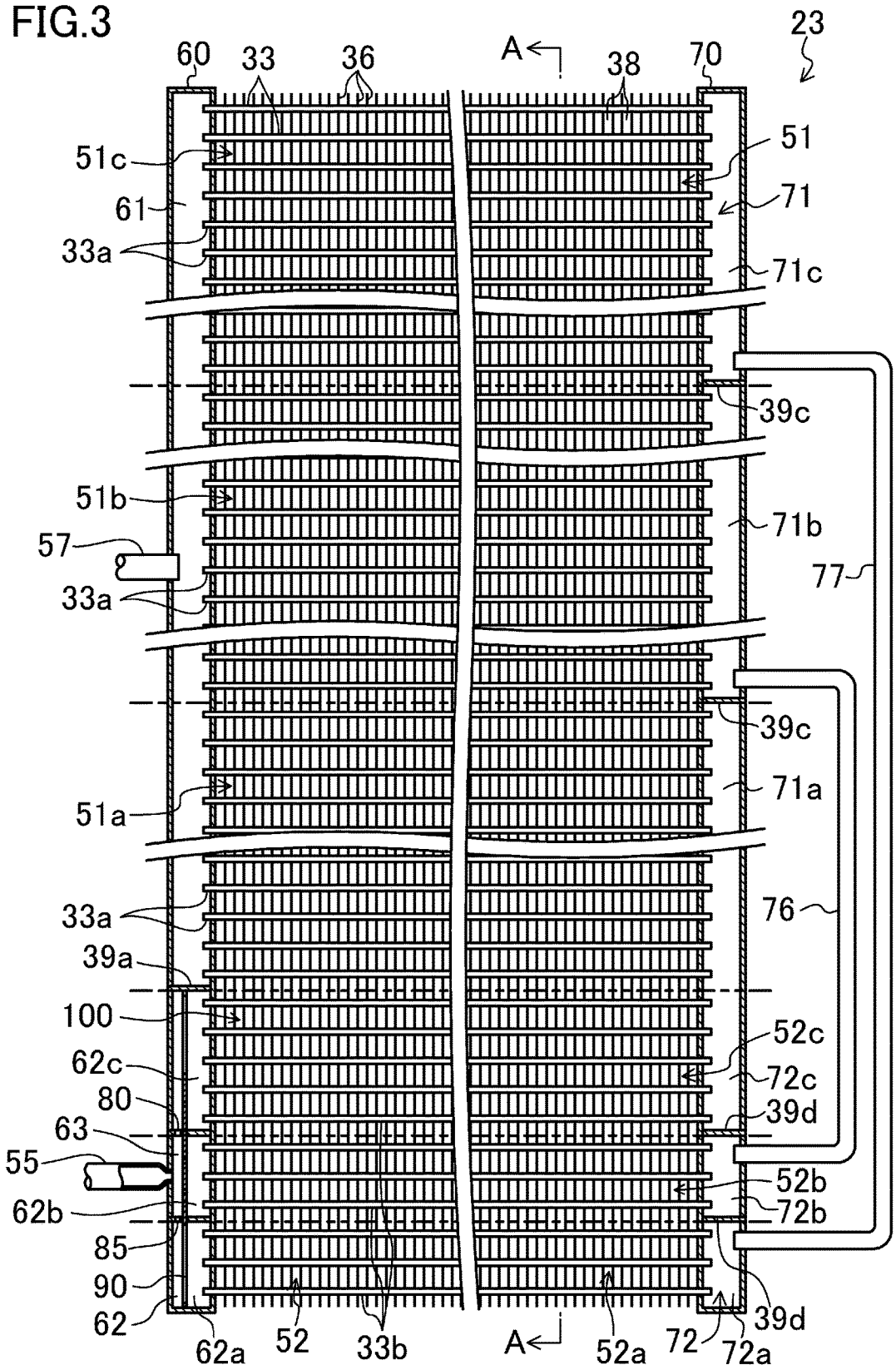
FIG. 3 is a cross-sectional view illustrating a portion of the outdoor heat exchanger of Embodiment 1, viewed from front.

As illustrated in FIGS. 2 and 3, the outdoor heat exchanger (23) includes a first header-collecting pipe (60), a second header-collecting pipe (70), and a large number of the flat tubes (33), and a large number of fins (36). The first header-collecting pipe (60), the second header-collecting pipe (70), the flat tubes (33), and the fins (35) are each an aluminum alloy member and are brazed to one another.

As will be detailed later, the outdoor heat exchanger (23) is divided into a principal heat exchange region (51) and an auxiliary heat exchange region (52). The flat tubes of the outdoor heat exchanger (23) include flat tubes (33*b*) which constitute the auxiliary heat exchange region (52) and flat tubes (33*a*) which constitute the principal heat exchange region (51).

Each of the first header-collecting pipe (60) and the second header-collecting pipe (70) has a long narrow cylindrical shape with both ends closed. In FIGS. 2 and 3, the first header-collecting pipe (60) stands in an upright position and forms the left edge of the outdoor heat exchanger (23), and the second header-collecting pipe (70) stands in an upright position and forms the right edge of the outdoor heat exchanger (23).

Figure 4:
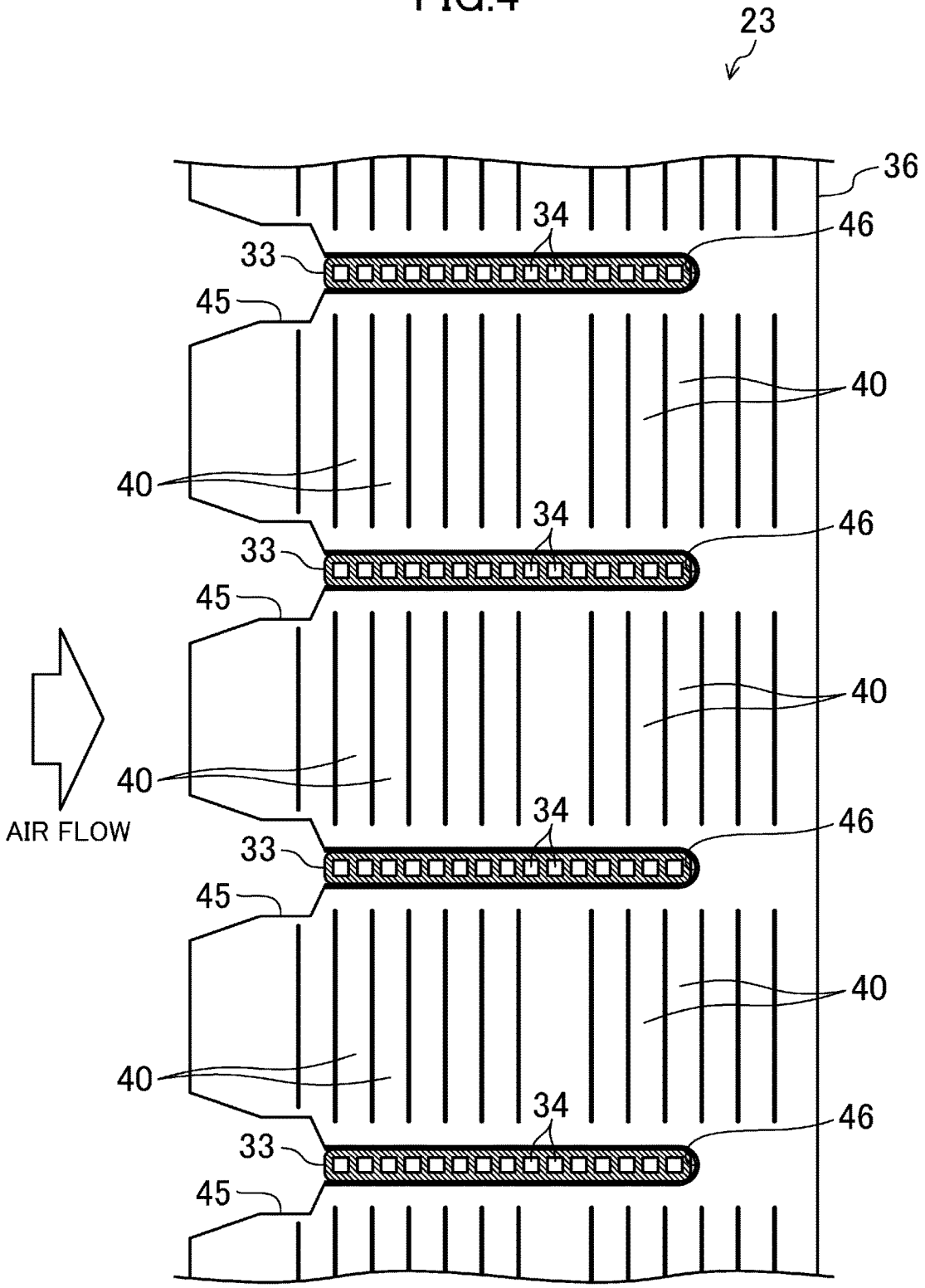
FIG. 4 is an enlarged cross-sectional view illustrating a portion of the cross section of the outdoor heat exchanger, taken along the line A-A in FIG. 3.

As illustrated in FIG. 4, each of the flat tubes (33) is a heat transfer tube having a flat oval cross-section. Each flat tube (33) has a thickness of about 1.5 mm and a width of about 15 mm. As illustrated in FIG. 3, in the outdoor heat exchanger (23), the direction in which the plurality of flat tubes (33) extend corresponds to the lateral direction, and the flat tubes (33) are arranged such that flat faces of the adjacent ones of the flat tubes (33) face each other. The plurality of flat tubes (33) are arranged one above the other at regular intervals and substantially in parallel with one another. Each of the flat tubes (33) has an end portion inserted in the first header-collecting pipe (60) and the other end portion inserted in the second header-collecting pipe (70).

As illustrated in FIG. 4, a plurality of fluid passages (34) extend in each of the flat tubes (33). The fluid passages (34) extend in the direction in which the flat tubes (33) extend. In each of the flat tubes (33), the plurality of fluid passages (34) are aligned in the width direction (i.e., in the direction perpendicular to the longitudinal direction) of the flat tubes (33). The plurality of fluid passages (34) extending in the flat tubes (33) each have an end communicating with the inner space of the first header-collecting pipe (60) and the other end communicating with the inner space of the second header-collecting pipe (70). The refrigerant supplied to the outdoor heat exchanger (23) exchanges heat with air while flowing through the fluid passages (34) extending in the flat tubes (33).

As illustrated in FIG. 4, each fin (36) is a vertically oriented plate fin made by subjecting a metal plate to press work. Each fin (36) has multiple long narrow notches (45) extending from the front edge (i.e., the edge located upstream of an air flow) of the fin (36) in the width direction of the fin (36). In each fin (36), the multiple notches (45) are arranged at regular intervals in the longitudinal direction (the vertical direction). A portion of each notch (45) located downstream of the air flow serves as a tube insertion section (46). Each tube insertion section (46) has a vertical width substantially equal to the thickness of the flat tubes (33) and a length substantially equal to the width of flat tubes (33). The flat tubes (33) are inserted into the tube insertion sections (46) of the fins (36), and brazed to circumferential portions of the tube insertion sections (46). Further, louvers (40) for promoting heat transfer are formed in each fin (36). The plurality of fins (36) are arranged across the direction in which the flat tubes (33) extend, and thereby divide spaces sandwiched between adjacent ones of the flat tubes (33) into a plurality of air flow paths (38).

As illustrated in FIGS. 2 and 3, the outdoor heat exchanger (23) is divided into two regions located one above the other, i.e., the heat exchange regions (51, 52). In the outdoor heat exchanger (23), the upper heat exchange region serves as the principal heat exchange region (51), and the lower heat exchange region serves as the auxiliary heat exchange region (52).

The heat exchange regions (51, 52) are each divided into three heat exchange sections (51*a*-51*c*, 52*a*-52*c*) located one above the other. That is, in the outdoor heat exchanger (23), the principal heat exchange region (51) and the auxiliary heat exchange region (52) are each divided into the same number of the heat exchange sections (51*a*-51*c*, 52*a*-52*c*). The heat exchange regions (51, 52) may be divided into two heat exchange sections or four or more heat exchange sections.

The principal heat exchange region (51) includes, in the order from bottom to top, the first principal heat exchange section (51*a*), the second principal heat exchange section (51*b*), and the third principal heat exchange section (51*c*). The first principal heat exchange section (51*a*) is constituted by 22 pieces of the flat tubes (33*a*), the second principal heat exchange section (51*b*) is constituted by 22 pieces of the flat tubes (33*a*), and the third principal heat exchange section (51*c*) is constituted by 24 pieces of the flat tubes (33*a*).

The auxiliary heat exchange region (52) includes, in the order from bottom to top, the first auxiliary heat exchange section (52*a*), the second auxiliary heat exchange section (52*b*), and the third auxiliary heat exchange section (52*c*). The first auxiliary heat exchange section (52*a*) is constituted by three pieces of the flat tubes (33*b*), the second auxiliary heat exchange section (52*b*) is constituted by three pieces of the flat tubes (33*b*), and the third auxiliary heat exchange section (52*c*) is constituted by five pieces of the flat tubes (33*b*).

As illustrated in FIG. 3, the inner space of the first header-collecting pipe (60) is partitioned by a partition plate (39*a*) into portions located one above the other. Thus, the first header-collecting pipe (60) includes the upper space (61) located above the partition plate (39*a*) and the lower space (62) located below the partition plate (39*a*).

The upper space (61) serves as a communicating space corresponding to the principal heat exchange region (51). The upper space (61) is a single continuous space communicating with all of the flat tubes (33*a*) constituting the principal heat exchange region (51). That is, the upper space (61) communicates with the flat tubes (33*a*) of the principal heat exchange sections (51*a*-51*c*).

The lower space (62) serves as an auxiliary communicating space corresponding to the auxiliary heat exchange region (52). As will be detailed later, the lower space (62) is partitioned into the same number (three, in this embodiment) of communicating chambers (62*a*-62*c*) as the number of the auxiliary heat exchange sections (52*a*-52*c*). The first communicating chamber (62*a*) which is the lowermost chamber communicates with all of the flat tubes (33*b*) constituting the first auxiliary heat exchange section (52*a*). The second communicating chamber (62*b*) which is located immediately above the first communicating chamber (62*a*) communicates with all of the flat tubes (33*b*) constituting the second auxiliary heat exchange section (52*b*). The third communicating chamber (62*c*) which is the uppermost chamber communicates with all of the flat tubes (33*b*) constituting the third auxiliary heat exchange section (52*c*).

The inner space of the second header-collecting pipe (70) is divided into a principal communicating space (71) corresponding to the principal heat exchange region (51) and an auxiliary communicating space (72) corresponding to the auxiliary heat exchange region (52).

The principal communicating space (71) is partitioned by two partition plates (39*c*) into portions located one above the other. Specifically, the partition plates (39*c*) partition the principal communicating space (71) into the same number (three, in this embodiment) of subspaces (71*a*-71*c*) as the number the principal heat exchange sections (51*a*-51*c*). The first subspace (71*a*) which is the lowermost subspace communicates with all of the flat tubes (33*a*) constituting the first principal heat exchange section (51*a*). The second subspace (71*b*) which is located immediately above the first subspace (71*a*) communicates with all of the flat tubes (33*a*) constituting the second principal heat exchange section (51*b*). The third subspace (71*c*) which is the uppermost subspace communicates with all of the flat tubes (33*a*) constituting the third principal heat exchange section (51*c*).

The auxiliary communicating space (72) is partitioned by two partition plates (39*d*) into portions located one above the other. Specifically, the partition plates (39*d*) partition the auxiliary communicating space (72) into the same number (three, in this embodiment) of subspaces (72*a*-72*c*) as the number of the auxiliary heat exchange sections (52*a*-52*c*). The fourth subspace (72*a*) which is the lowermost subspace communicates with all of the flat tubes (33*b*) constituting the first auxiliary heat exchange section (52*a*). The fifth subspace (72*b*) which is located immediately above the fourth subspace (72*a*) communicates with all of the flat tubes (33*b*) constituting the second auxiliary heat exchange section (52*b*). The sixth subspace (72*c*) which is the uppermost subspace communicates with all of the flat tubes (33*b*) constituting the third auxiliary heat exchange section (52*c*).

Two connection pipes (76, 77) are attached to the second header-collecting pipe (70). The first connection pipe (76) has an end connected to the second subspace (71*b*) corresponding to the second principal heat exchange section (51*b*) and the other end connected to the fifth subspace (72*b*) corresponding to the second auxiliary heat exchange section (52*b*). The second connection pipe (77) has an end connected to the third subspace (71*c*) corresponding to the third principal heat exchange section (51*c*) and the other end connected to the fourth subspace (72*a*) corresponding to the first auxiliary heat exchange section (52*a*). In the second header-collecting pipe (70), the sixth subspace (72*c*) corresponding to the third auxiliary heat exchange section (52*c*) and the first subspace (71*a*) corresponding to the first principal heat exchange section (51*a*) together form a single continuous space.

Thus, in the outdoor heat exchanger (23) of this embodiment, the first principal heat exchange section (51*a*) is connected in series to the third auxiliary heat exchange section (52*c*), the second principal heat exchange section (51*b*) is connected in series to the second auxiliary heat exchange section (52*b*), and the third principal heat exchange section (51*c*) is connected in series to the first auxiliary heat exchange section (52*a*). That is, in the outdoor heat exchanger (23) of this embodiment, the first auxiliary heat exchange section (52*a*) corresponds to the third principal heat exchange section (51*c*), the second auxiliary heat exchange section (52*b*) corresponds to the second principal heat exchange section (51*b*), and the third auxiliary heat exchange section (52*c*) corresponds to the first principal heat exchange section (51*a*).

Here, a tube number ratio $R_1$ is obtained by dividing the number (i.e. 22) of the flat tubes (33*a*) of the first principal heat exchange section (51*a*) by the number (i.e. 5) of the flat tubes (33*b*) of the third auxiliary heat exchange section (52*c*) ($R_1$=22/5=4.4). A tube number ratio $R_2$ is obtained by dividing the number (i.e. 22) of the flat tubes (33*a*) of the second principal heat exchange section (51*b*) by the number (i.e. 3) of the flat tubes (33*b*) of the second auxiliary heat exchange section (52*b*) ($R_2$=22/3≈7.3). A tube number ratio $R_3$ is obtained by dividing the number (i.e. 24) of the flat tubes (33*a*) of the third principal heat exchange section (51*c*) by the number (i.e. 3) of the flat tubes (33*b*) of the first auxiliary heat exchange section (52*a*) ($R_3$=24/3=8.0). In the outdoor heat exchanger (23) of this embodiment, the tube number ratio $R_1$ of the first principal heat exchange section (51*a*) that is the lowermost principal heat exchange section of the principal heat exchange sections (51*a*-51*c*) is the smallest.

The first principal heat exchange section (51*a*) and the third auxiliary heat exchange section (52*c*), which have the smallest tube number ratio $R_1$, form a discharge accelerator (100). The discharge accelerator (100) accelerates discharge of the liquid refrigerant from a lower portion of the first principal heat exchange section (51*a*) during defrosting which will be described later.

As illustrated in FIGS. 2 and 3, the outdoor heat exchanger (23) is equipped with a liquid connection pipe (55) and a gas connection pipe (57). Each of the liquid connection pipe (55) and the gas connection pipe (57) is an aluminum alloy member formed in a cylindrical shape. The liquid connection pipe (55) and the gas connection pipe (57) are brazed to the first header-collecting pipe (60).

As will be detailed later, an end of the liquid connection pipe (55) which is a tubular member is in connection to a lower portion of the first header-collecting pipe (60) and communicates with the lower space (62). The other end of the liquid connection pipe (55) is connected, through a pipe fitting (not shown), to a copper pipe (17) which connects the outdoor heat exchanger (23) to the expansion valve (24).

An end of the gas connection pipe (57) is in connection to a portion located almost at the vertical middle of the upper space (61) of the first header-collecting pipe (60) and communicates with the upper space (61). The other end of the gas connection pipe (57) is connected, through a pipe fitting (not shown), to a copper pipe (18) which connects the outdoor heat exchanger (23) to the third port of the four-way switching valve (22).

<Configuration of Lower Portion of First Header-Collecting Pipe>

The configuration of the lower portion of the first header-collecting pipe (60) is now described with reference to FIGS. 5-7 as appropriate. Hereinafter, a portion of the peripheral face of the first header-collecting pipe (60) where the flat tubes (33*b*) are positioned is referred to as the "front face," and a portion of the peripheral face of the first header-collecting pipe (60) located opposite to the flat tubes (33*b*) is referred to as the "back face."

Figure 5:
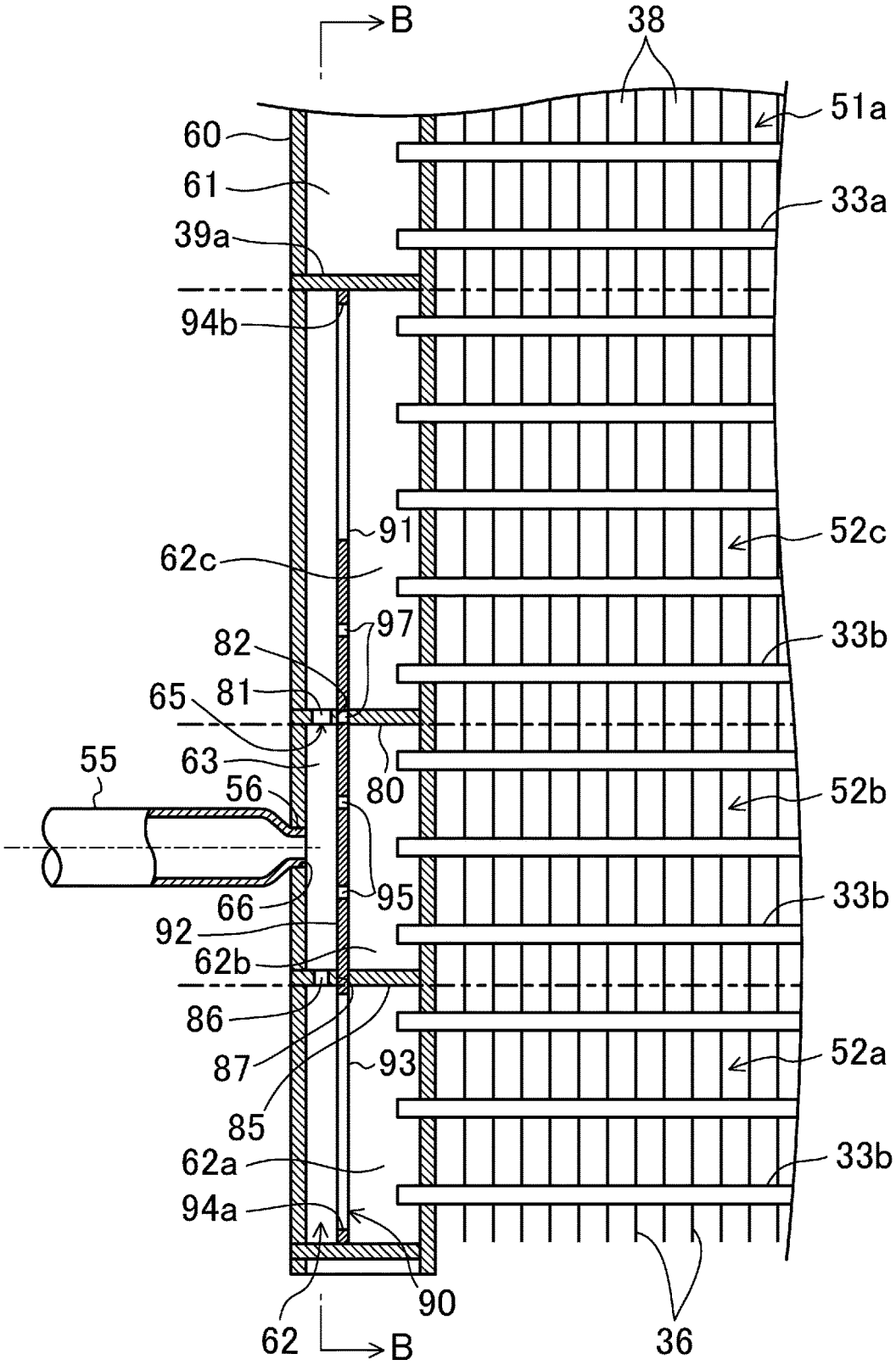
FIG. 5 is an enlarged cross-sectional view illustrating a portion of the outdoor heat exchanger of Embodiment 1, viewed from front.

In the lower space (62) of the first header-collecting pipe (60), an upper lateral partition plate (80), a lower lateral partition plate (85), and a vertical partition plate (90) are placed (see FIG. 5). The lower space (62) is partitioned by these lateral partition plates (80, 85) and vertical partition plate (90) into the three communicating chambers (62*a*-62*c*)

and one mixing chamber (63). Each of the lateral partition plates (80, 85) and vertical partition plate (90) is made of an aluminum alloy.

The upper lateral partition plate (80) and the lower lateral partition plate (85) have a disc shape and partition the lower space (62) into portions located one above the other. The upper lateral partition plate (80) and the lower lateral partition plate (85) are brazed to the first header-collecting pipe (60). The upper lateral partition plate (80) is located on the extension of the boundary between the second auxiliary heat exchange section (52*b*) the third auxiliary heat exchange section (52*c*) and separates the second communicating chamber (62*b*) from the third communicating chamber (62*c*). The lower lateral partition plate (85) is located on the extension of the boundary between the first auxiliary heat exchange section (52*a*) and the second auxiliary heat exchange section (52*b*) and separates the first communicating chamber (62*a*) from the second communicating chamber (62*b*).

Figure 6A:
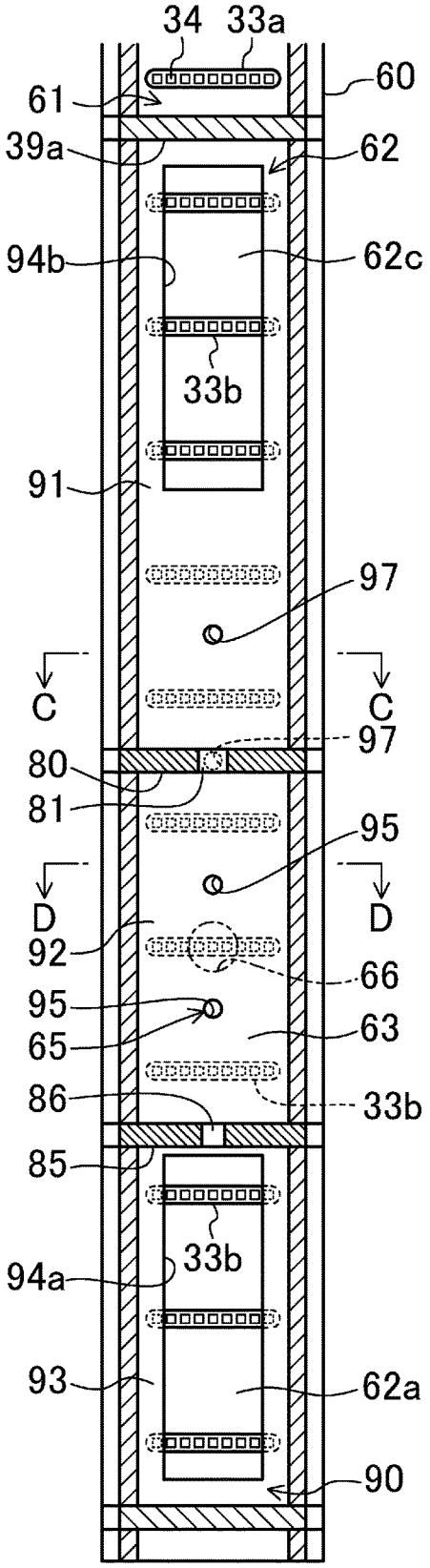
FIGS. 6A-6C are enlarged cross-sectional views of portions of the outdoor heat exchanger of Embodiment 1. Specifically.
Figure 6B:
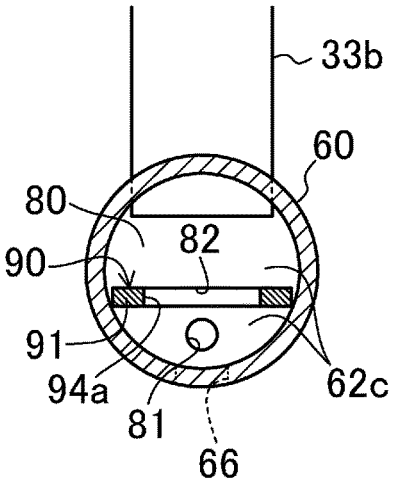
Figure 6C:
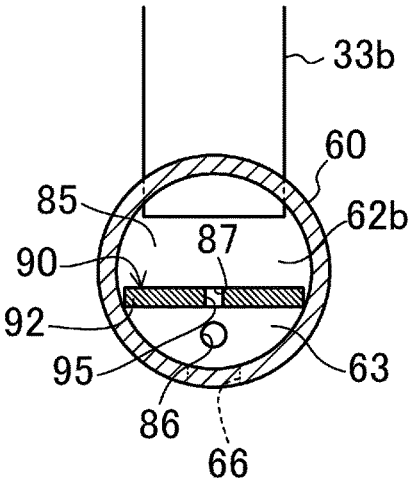

A slit (82) and a communication through-hole (81) are formed in the upper lateral partition plate (80), and a slit (87) and a communication through-hole (86) are formed in the lower lateral partition plate (85) (see FIGS. 5 and 6). Each of the slits (82, 87) is a narrow rectangular hole penetrating the corresponding one of the lateral partition plates (80, 85) in the thickness direction. Each of the communication through-holes (81, 86) is a circular hole penetrating the corresponding one of the lateral partition plates (80, 85) in the thickness direction. The communication through-hole (81) of the upper lateral partition plate (80) has a diameter which is slightly larger than that of the communication through-hole (86) of the lower lateral partition plate (85).

Figure 7:
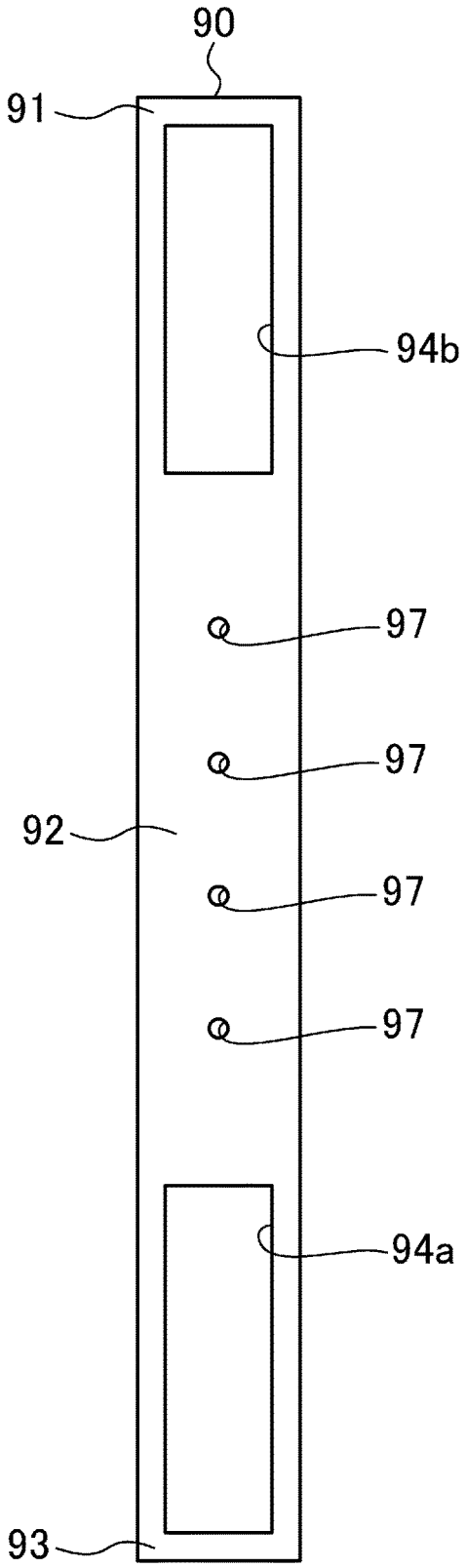
FIG. 7 is a plan view of a vertical partition plate to be provided in the outdoor heat exchanger of Embodiment 1.

The vertical partition plate (90) has a vertically oriented rectangular shape (see FIG. 7). The vertical partition plate (90) penetrates through the slit (82) of the upper lateral partition plate (80) and the slit (87) of the lower lateral partition plate (85) (see FIGS. 5 and 6).

The vertical partition plate (90) includes an upper portion (91) located above the upper lateral partition plate (80), an intermediate portion (92) located between the upper lateral partition plate (80) and the lower lateral partition plate (85), and a lower portion (93) located below the lower lateral partition plate (85) (see FIGS. 5 and 6). The intermediate portion (92) of the vertical partition plate (90) partitions the space between the upper lateral partition plate (80) and the lower lateral partition plate (85) into the second communicating chamber (62*b*) located on the front face of the first header-collecting pipe (60) and the mixing chamber (63) located on the back face of the first header-collecting pipe (60).

In the vertical partition plate (90), two rectangular openings (94*a*, 94*b*) and four circular through holes (97, 97, 97, 97) are formed (see FIG. 7). The openings (94*a*, 94*b*) are located near the upper end and the lower end of the vertical partition plate (90), respectively. The openings (94*a*, 94*b*) penetrate the vertical partition plate (90) in the thickness direction. The four through holes (97, 97, 97, 97) are arranged at regular intervals between the two openings (94*a*, 94*b*) of the vertical partition plate (90). Each through hole (97) penetrates the vertical partition plate (90) in the thickness direction.

When the vertical partition plate (90) is installed in the first header-collecting pipe (60), the opening and the through holes are positioned, as follows. The lower opening (94*a*) is positioned below the lower lateral partition plate (85). The lower located two (97, 97) of the through holes are positioned between the upper lateral partition plate (80) and the lower lateral partition plate (85). The upper opening (94*b*) and the first uppermost through hole (97) are positioned above the upper lateral partition plate (80). The second uppermost through hole (97) is positioned in the slit (82) of the upper lateral partition plate (80).

As described above, when the vertical partition plate (90) is installed in the first header-collecting pipe (60), the two lower through holes (97, 97) are positioned between the upper lateral partition plate (80) and the lower lateral partition plate (85). These two through holes (97, 97) positioned between the upper lateral partition plate (80) and the lower lateral partition plate (85) serve as communication through-holes (95) which cause the mixing chamber (63) to communicate with the second communicating chamber (62*b*).

In the peripheral wall of the first header-collecting pipe (60), a connection port into which the liquid connection pipe (55) is inserted is formed. The connection port (66) is a circular through hole. The connection port (66) is located in a portion of the first header-collecting pipe (60) between the upper lateral partition plate (80) and the lower lateral partition plate (85), and communicates with the mixing chamber (63).

<Refrigerant Flow in Outdoor Heat Exchanger (when Functioning as Condenser)>

When the air conditioner (10) is performing the cooling operation, the outdoor heat exchanger (23) is functioning as a condenser. A flow of the refrigerant in the outdoor heat exchanger (23) during the cooling operation is now described.

The gaseous refrigerant discharged from the compressor (21) is supplied to the outdoor heat exchanger (23). The gaseous refrigerant sent from the compressor (21) passes through the gas connection pipe (57) and flows into the upper space (61) of the first header-collecting pipe (60), and then, is distributed to the flat tubes (33*a*) of the principal heat exchange region (51). In the principal heat exchange sections (51*a*-51*c*) of the principal heat exchange region (51), the refrigerant having flowed into the fluid passages (34) of the flat tubes (33*a*) dissipates heat into outdoor air and condenses while flowing through the fluid passages (34). Thereafter, the refrigerant flows into the corresponding subspaces (71*a*-71*c*) of the second header-collecting pipe (70).

The refrigerant having flowed into the subspaces (71*a*-71*c*) of the principal communicating space (71) is sent to the corresponding subspaces (72*a*-72*c*) of the auxiliary communicating space (72). Specifically, the refrigerant having flowed into the first subspace (71*a*) of the principal communicating space (71) downwardly flows and enters the sixth subspace (72*c*) of the auxiliary communicating space (72). The refrigerant having flowed into the second subspace (71*b*) of the principal communicating space (71) passes through the first connection pipe (76) and enters the fifth subspace (72*b*) of the auxiliary communicating space (72). The refrigerant having flowed into the third subspace (71*c*) of the principal communicating space (71) passes through the second connection pipe (77) and enters the fourth subspace (72*a*) of the auxiliary communicating space (72).

The refrigerant having flowed into the subspaces (72*a*-72*c*) of the auxiliary communicating space (72) is distributed to the flat tubes (33*b*) of the corresponding auxiliary heat exchange sections (52*a*-52*c*). While flowing though the fluid passages (34) of the flat tubes (33*b*), the refrigerant dissipates heat into outdoor air to be converted into subcooled liquid, and then, flows into the corresponding communicating chambers (62*a*-62*c*) of the lower space (62) of the first header-collecting pipe (60). The refrigerant then enters the liquid connection pipe (55) via the mixing chamber (63). In this manner, the refrigerant flows out of the outdoor heat exchanger (23).

<Refrigerant Flow in Outdoor Heat Exchanger (when Functioning as Evaporator)>

When the air conditioner (10) is performing the heating operation, the outdoor heat exchanger (23) is functioning as an evaporator. A flow of the refrigerant in the outdoor heat exchanger (23) during the heating operation is now described.

The refrigerant having expanded upon passing through the expansion valve (24) and being in a gas-liquid two-phase state is supplied to the outdoor heat exchanger (23). Specifically, the refrigerant having passed through the expansion valve (24) flows through the liquid connection pipe (55) and enters the mixing chamber (63) in the first header-collecting pipe (60). Upon entering mixing chamber (63), the refrigerant in a gas-liquid two-phase state collides against the vertical partition plate (90), and consequently, the gaseous component and the liquid component of the refrigerant in a gas-liquid two-phase state are mixed together. Thus, the refrigerant in the mixing chamber (63) is homogenized and the wetness of the refrigerant in the mixing chamber (63) becomes generally uniform.

The refrigerant in the mixing chamber (63) is distributed to the communicating chambers (62*a*-62*c*). Specifically, the refrigerant in the mixing chamber (63) passes through the communication through-hole (86) of the lower lateral partition plate (85) to enter the first communicating chamber (62*a*), passes through the communication through-hole (95) of the vertical partition plate (90) to enter the second communicating chamber (62*b*), and passes through the communication through-hole (81) of the upper lateral partition plate (80) to enter the third communicating chamber (62*c*).

The refrigerant having flowed into the communicating chambers (62*a*-62*c*) of the first header-collecting pipe (60) is distributed to the flat tubes (33*b*) of the corresponding auxiliary heat exchange sections (52*a*-52*c*) and caused to flow through the fluid passages (34) of the flat tubes (33*b*). While flowing through the fluid passages (34), the refrigerant absorbs heat from outdoor air, and part of the liquid component of the refrigerant evaporates. The refrigerant having passed through the fluid passages (34) of the flat tubes (33*b*) enters the corresponding subspaces (72*a*-72*c*) of the auxiliary communicating space (72) in the second header-collecting pipe (70).

The refrigerant having flowed into the subspaces (72*a*-72*c*) of the auxiliary communicating space (72) is sent to the corresponding subspaces (71*a*-71*c*) of the principal communicating space (71). Specifically, the refrigerant having flowed into the fourth subspace (72*a*) of the auxiliary communicating space (72) passes through the second connection pipe (77) and enters the third subspace (71*c*) of the principal communicating space (71). The refrigerant having flowed into the fifth subspace (72*b*) of the auxiliary communicating space (72) passes through the first connection pipe (76) and enters the second subspace (71*b*) of the principal communicating space (71). The refrigerant having flowed into the sixth subspace (72*c*) of the auxiliary communicating space (72) upwardly flows and enters the first subspace (71*a*) of the principal communicating space (71).

The refrigerant having flowed into the subspaces (71*a*-71*c*) of the principal communicating space (71) is distributed to the flat tubes (33*a*) of the corresponding principal heat exchange sections (51*a*-51*c*) and caused to flow through the fluid passages (34) of the flat tubes (33*a*). While flowing through the fluid passages (34), the refrigerant absorbs heat from outdoor air and evaporates to enter a substantially single-phase gas state. Thereafter, the refrigerant flows into the upper space (61) of the first header-collecting pipe (60), and passes through the gas connection pipe (57). In this manner, the refrigerant flows out of the outdoor heat exchanger (23).

<Refrigerant Flow in Outdoor Heat Exchanger (During Defrosting)>

Figure 8:
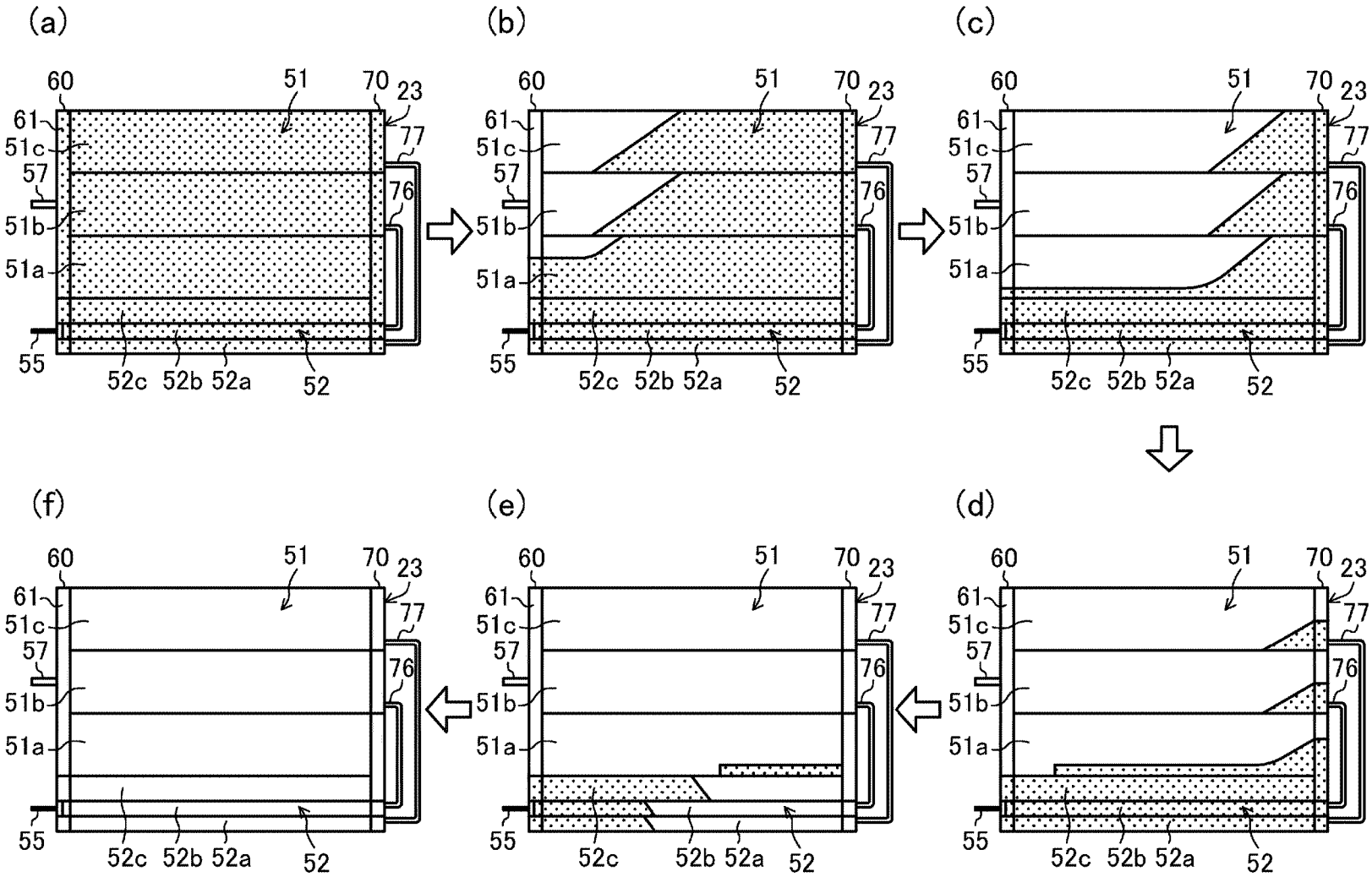
FIG. 8 shows front views of the outdoor heat exchanger of Embodiment 1 in which progress of defrosting is schematically illustrated.

As described above, the air conditioner (10) temporarily suspends the heating operation to carry out the defrosting operation when the predetermined defrosting start conditions are satisfied. When the air conditioner (10) is performing the defrosting operation, the outdoor heat exchanger (23) carries out defrosting. Here, a flow of the refrigerant in the outdoor heat exchanger (23) during the defrosting is described with reference to FIG. 8. In FIG. 8, regions where the liquid refrigerant is present are marked with dots.

When the air conditioner (10) is performing the heating operation, the outdoor heat exchanger (23) is functioning as an evaporator. However, a large amount of frost having formed on the outdoor heat exchanger (23) allows the refrigerant to absorb almost no heat from outdoor air. Consequently, as illustrated in (a) of FIG. 8, the major portion of the outdoor heat exchanger (23) is filled with the liquid refrigerant at the start of the defrosting operation.

When the air conditioner (10) starts the defrosting operation, the high-temperature and high-pressure gaseous refrigerant discharged from the compressor (21) passes through the gas connection pipe (57) and flows into the upper space (61) of the first header-collecting pipe (60). The refrigerant then flows from the upper space (61) into the flat tubes (33*a*) of the principal heat exchange sections (51*a*-51*c*), where the gaseous refrigerant dissipates heat to the frost, and condenses. The frost on the outdoor heat exchanger (23) is heated and melted by the gaseous refrigerant.

In the outdoor heat exchanger (23), the gaseous refrigerant hardly condenses in portions where the frost has already been melted, and dissipates heat and condenses when reaching portions where the frost remains. Consequently, as illustrated in (b)-(e) of FIG. 8, in the principal heat exchange sections (51*a*-51*c*) of the outdoor heat exchanger (23) performing the defrosting, the regions where the gaseous refrigerant is present (i.e., the regions where the frost has been melted) gradually expand from the first header-collecting pipe (60) toward the second header-collecting pipe (70).

Here, in the outdoor heat exchanger (23) of this embodiment, the number (i.e., five) of the flat tubes (33*b*) constituting the third auxiliary heat exchange section (52*c*) is greater than the number (i.e. three) of the flat tubes (33*b*) constituting each of the other auxiliary heat exchange sections (52*a*, 52*b*). Accordingly, as compared to a case where the third auxiliary heat exchange section (52*c*) and the other auxiliary heat exchange sections (52*a*, 52*b*) are each equally constituted by three flat tubes (33*b*), the refrigerant flows into the first principal heat exchange section (51*a*) of this embodiment at an increased flow rate during the defrosting. When the flow rate at which the refrigerant flows into the first principal heat exchange section (51*a*) during the defrosting is increased, a flow rate at which the refrigerant flows through the flat tubes (33*a*) of the first principal heat exchange section (51*a*) is also increased. Consequently, force which pushes and moves the liquid refrigerant present in lowermost ones of the flat tubes (33*a*) of the first principal heat exchange section (51*a*) and in a bottom portion of the upper space (61) of the first header-collecting pipe (60) toward the second header-collecting pipe (70) becomes strong, thereby accelerating discharge of the liquid refrigerant from the lower portion of the first principal heat exchange section (51*a*).

Thus, in the first principal heat exchange section (51*a*) that is the lowermost principal heat exchange section, the force that pushes the liquid refrigerant present in the flat tubes (33*a*) toward the second header-collecting pipe (70) becomes strong. Accordingly, the region where the gaseous refrigerant is present (i.e. the region where the frost has been melted) speedily expands also in the first principal heat exchange section (51*a*). That is, the region where the gaseous refrigerant is present speedily expands also in the lowermost ones of the flat tubes (33*a*) of the first principal heat exchange section (51*a*).

In a state where the inside of the outdoor heat exchanger (23) is substantially filled only with the gaseous refrigerant (i.e., the state illustrated in (f) of FIG. 8), all of the frost on the outdoor heat exchanger (23) has been melted. Accordingly, the air conditioner (10) finishes the defrosting operation when the outdoor heat exchanger (23) enters this state.

—Advantages of Embodiment 1—

In the outdoor heat exchanger (23) of this embodiment, the tube number ratios are obtained by dividing "the number of the flat tubes (33*a*) of each of the principal heat exchange sections (51*a*-51*c*)" by "the number of the flat tubes (33*b*) of a corresponding one of the auxiliary heat exchange sections (52*a*-52*c*)," and the tube number ratio $R_1$ between the first principal heat exchange section (51*a*) that is the lowermost principal heat exchange section and the corresponding third auxiliary heat exchange section (52*c*) is the smallest of the tube number ratios. Consequently, in the first principal heat exchange section (51*a*), the flow rate at which the gaseous refrigerant flows through each flat tube (33*a*) is increased, and it becomes easy to push and move, toward the second header-collecting pipe (70), the liquid refrigerant present in the lowermost ones of the flat tubes (33*a*) of the first principal heat exchange section (51*a*) and the bottom portion of the communicating space (61).

When the air conditioner (10) is performing the defrosting operation, discharge of the liquid refrigerant from the lowermost ones of the flat tubes (33*a*) of the first principal heat exchange section (51*a*) and the bottom portion of the communicating space (61) of the first header-collecting pipe (60) is accelerated in the outdoor heat exchanger (23). That is, during the defrosting, in the outdoor heat exchanger (23) of this embodiment, discharge of the liquid refrigerant from the lower portion of the first principal heat exchange section (51*a*) is accelerated.

It is therefore possible to shorten the time from the start of the defrosting to entering into a state where the high-pressure gaseous refrigerant is allowed to flow into all of the flat tubes (33*a*) constituting the principal heat exchange sections (51*a*-51*c*). After the high-pressure gaseous refrigerant has begun flowing into all of the flat tubes (33*a*) constituting the principal heat exchange sections (51*a*-51*c*), the frost is gradually melted in the entire principal heat exchange sections (51*a*-51*c*). Therefore, according to this embodiment, it is possible to shorten the time required to defrost the portion where frost would be allowed to remain according to the conventional techniques (i.e., the lower portion of the first principal heat exchange section (51*a*) that is the lowermost principal heat exchange section). As a result, the time required to defrost the entire outdoor heat exchanger (23) can be shortened.

In particular, in this embodiment, discharge of the liquid refrigerant from the lower portion of the principal heat exchange section (51*a*) is accelerated by adjusting the numbers of flat tubes (33) constituting the principal heat exchange sections (51*a*-51*c*) and the auxiliary heat exchange sections (52*a*-52*c*). Therefore, according to this embodiment, it is possible to shorten the time required to defrost the entire outdoor heat exchanger (23) without adding any new parts or members to the outdoor heat exchanger (23).

—Variations of Embodiment 1—

In the foregoing description of the outdoor heat exchanger (23) of this embodiment, the number of the flat tubes (33*a*) of each of the principal heat exchange sections (51*a*-51*c*) and the number of the flat tubes (33*b*) of each of the auxiliary heat exchange sections (52*a*-52*c*) are mere examples.

In the outdoor heat exchanger (23) of this embodiment, the first principal heat exchange section (51*a*) may be constituted by 20 pieces of the flat tubes (33*a*), the second principal heat exchange section (51*b*) may be constituted by 22 pieces of the flat tubes (33*a*), and the third principal heat exchange section (51*c*) may be constituted by 24 pieces of the flat tubes (33*a*). The first auxiliary heat exchange section (52*a*) may be constituted by three pieces of the flat tubes (33*b*), the second auxiliary heat exchange section (52*b*) may be constituted by three pieces of the flat tubes (33*b*), and the third auxiliary heat exchange section (52*c*) may be constituted by seven pieces of the flat tubes (33*b*).

If this is the case, the tube number ratio $R_1$ obtained by dividing the number (i.e. 20) of the flat tubes (33*a*) of the first principal heat exchange section (51*a*) by the number (i.e. 7) of the flat tubes (33*b*) of the third auxiliary heat exchange section (52*c*) is approximately 2.9 ($R_1$=20/7≈2.9). The tube number ratio $R_2$ obtained by dividing the number (i.e. 22) of the flat tubes (33*a*) of the second principal heat exchange section (51*b*) by the number (i.e. 3) of the flat tubes (33*b*) of the second auxiliary heat exchange section (52*b*) is approximately 7.3 ($R_{2=22/3\sim7.3}$). The tube number ratio $R_3$ obtained by dividing the number (i.e. 24) of the flat tubes (33*a*) of the third principal heat exchange section (51*c*) by the number (i.e. 3) of the flat tubes (33*b*) of the first auxiliary heat exchange section (52*a*) is 8.0 ($R_3$=24/3=8.0). In this case, the tube number ratio $R_1$ of the first principal heat exchange section (51*a*) that is the lowermost principal heat exchange section of the principal heat exchange sections (51*a*-51*c*) is also the smallest.

Alternatively, in the outdoor heat exchanger (23) of this embodiment, the first principal heat exchange section (51*a*) may be constituted by 19 pieces of the flat tubes (33*a*), the second principal heat exchange section (51*b*) may be constituted by 22 pieces of the flat tubes (33*a*), and the third principal heat exchange section (51*c*) may be constituted by 24 pieces of the flat tubes (33*a*). The first auxiliary heat exchange section (52*a*) may be constituted by three pieces of the flat tubes (33*b*), the second auxiliary heat exchange section (52*b*) may be constituted by three pieces of the flat tubes (33*b*), and the third auxiliary heat exchange section (52*c*) may be constituted by eight pieces of the flat tubes (33*b*).

If this is the case, the tube number ratio $R_1$ obtained by dividing the number (i.e. 19) of the flat tubes (33*a*) of the first principal heat exchange section (51*a*) by the number (i.e. 8) of the flat tubes (33*b*) of the third auxiliary heat exchange section (52*c*) is approximately 2.4 ($R_1$=19/8≈2.4). The tube number ratio $R_2$ obtained by dividing the number (i.e. 22) of the flat tubes (33*a*) of the second principal heat exchange section (51*b*) by the number (i.e. 3) of the flat tubes (33*b*) of the second auxiliary heat exchange section (52*b*) is approximately 7.3 ($R_2$=22/3≈7.3). The tube number ratio $R_3$ obtained by dividing the number (i.e. 24) of the flat tubes (33*a*) of the third principal heat exchange section (51*c*)

by the number (i.e. 3) of the flat tubes (33*b*) of the first auxiliary heat exchange section (52*a*) is 8.0 ($R_3$=24/3=8.0). In this case, the tube number ratio $R_1$ of the first principal heat exchange section (51*a*) that is the lowermost principal heat exchange section of the principal heat exchange sections (51*a*-51*c*) is also the smallest.

<<Embodiment 2>>

Embodiment 2 of the present invention is described next. The outdoor heat exchanger (23) of this embodiment is different from the outdoor heat exchanger (23) of Embodiment 1 in the number of the flat tubes (33*a*) of the principal heat exchange sections (51*a*-51*c*) and the number of the flat tubes (33*b*) of the third auxiliary heat exchange section (52*c*). The differences between the outdoor heat exchanger (23) of this embodiment and that of Embodiment 1 are described below. In the same manner as Embodiment 1, the numbers of the flat tubes (33) are merely described as examples.

Figure 9:
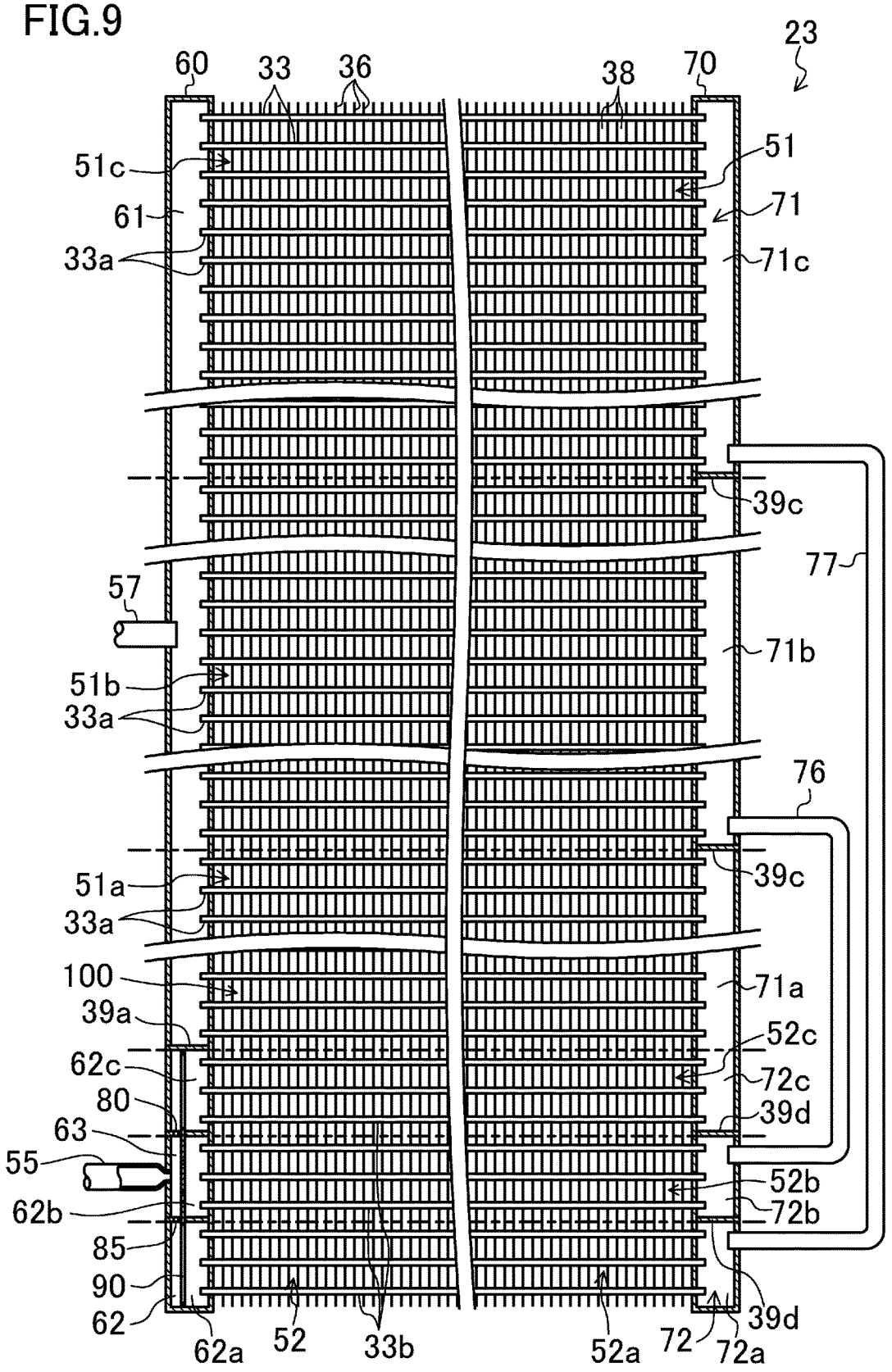
FIG. 9 is a cross-sectional view illustrating a portion of an outdoor heat exchanger of Embodiment 2, viewed from front.

As illustrated in FIG. 9, in the outdoor heat exchanger (23) of this embodiment, the auxiliary heat exchange sections (52*a*-52*c*) are each constituted by the same number of the flat tubes (33*b*). Specifically, in the outdoor heat exchanger (23) of this embodiment, the first principal heat exchange section (51*a*) is constituted by 16 pieces of the flat tubes (33*a*), the second principal heat exchange section (51*b*) is constituted by 26 pieces of the flat tubes (33*a*), and the third principal heat exchange section (51*c*) is constituted by 28 pieces of the flat tubes (33*a*). The first auxiliary heat exchange section (52*a*) is constituted by three pieces of the flat tubes (33*b*), the second auxiliary heat exchange section (52*b*) is constituted by three pieces of the flat tubes (33*b*), and the third auxiliary heat exchange section (52*c*) is constituted by three pieces of the flat tubes (33*b*).

The tube number ratio $R_1$ obtained by dividing the number (i.e. 16) of the flat tubes (33*a*) of the first principal heat exchange section (51*a*) by the number (i.e. 3) of the flat tubes (33*b*) of the third auxiliary heat exchange section (52*c*) is approximately 5.3 ($R_1$=16/3≈5.3). The tube number ratio $R_2$ obtained by dividing the number (i.e. 26) of the flat tubes (33*a*) of the second principal heat exchange section (51*b*) by the number (i.e. 3) of the flat tubes (33*b*) of the second auxiliary heat exchange section (52*b*) is approximately 8.7 ($R_2$=26/3≈8.7). The tube number ratio $R_3$ obtained by dividing the number (i.e. 28) of the flat tubes (33*a*) of the third principal heat exchange section (51*c*) by the number (i.e. 3) of the flat tubes (33*b*) of the first auxiliary heat exchange section (52*a*) is approximately 9.3 ($R_3$=28/3≈9.3). In the outdoor heat exchanger (23) of this embodiment, the tube number ratio $R_1$ of the first principal heat exchange section (51*a*) that is the lowermost principal heat exchange section of the principal heat exchange sections (51*a*-51*c*) is the smallest.

In the manner similar to Embodiment 1, in the outdoor heat exchanger (23) of this embodiment, the first principal heat exchange section (51*a*) and the third auxiliary heat exchange section (52*c*), which have the smallest tube number ratio $R_1$, form the discharge accelerator (100), which accelerates discharge of the liquid refrigerant from a lower portion of the first principal heat exchange section (51*a*) during defrosting.

Figure 10:
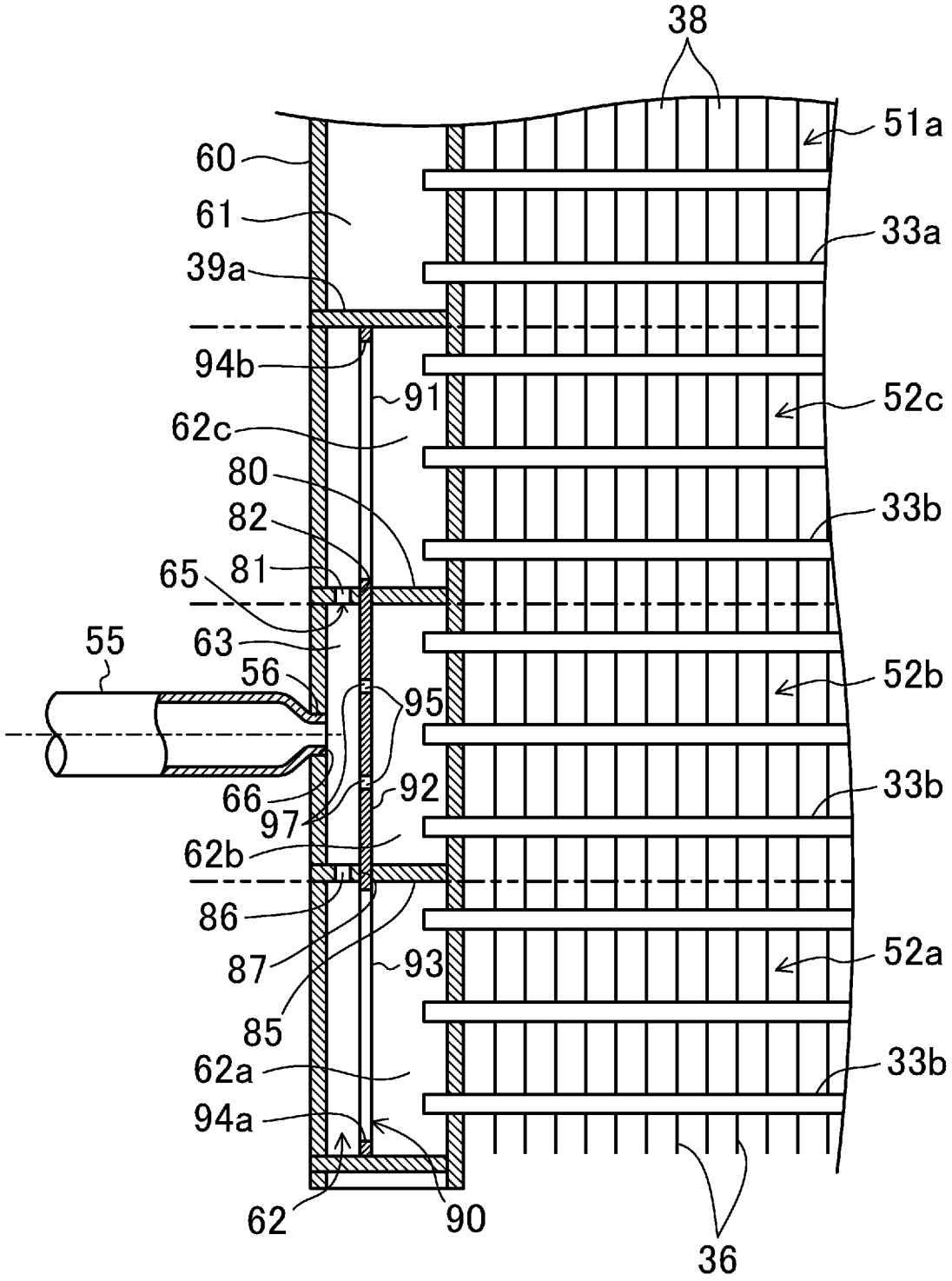
FIG. 10 is an enlarged cross-sectional view illustrating a portion of the outdoor heat exchanger of Embodiment 2, viewed from front.

As illustrated in FIG. 10, the vertical partition plate (90) of this embodiment has a shape different from that of the vertical partition plate (90) of Embodiment 1. Specifically, in the vertical partition plate (90) of this embodiment, only two through holes (97) are formed. When the vertical partition plate (90) is installed in the first header-collecting pipe (60), the opening and the through holes are positioned, as follows. The lower opening (94*a*) is positioned below the lower lateral partition plate (85), the two through holes (97) are positioned between the upper lateral partition plate (80) and the lower lateral partition plate (85), and the upper opening (94*b*) is positioned above the upper lateral partition plate (80). In the outdoor heat exchanger (23) of this embodiment, all of the through holes (97) formed in the vertical partition plate (90) serve as communication through-holes (95) which cause the mixing chamber (63) to communicate with the second communicating chamber (62*b*).

<Refrigerant Flow in Outdoor Heat Exchanger (During Defrosting)>

When the air conditioner (10) is performing the defrosting operation, the high-temperature and high-pressure gaseous refrigerant discharged from the compressor (21) is supplied, through the gas connection pipe (57), to the upper space (61) of the first header-collecting pipe (60) of the outdoor heat exchanger (23) of this embodiment. Frost on the outdoor heat exchanger (23) is heated and melted by the supplied gaseous refrigerant. In the outdoor heat exchanger (23) of this embodiment, in accordance with progress of defrosting, regions where the gaseous refrigerant is present expands. The gaseous refrigerant eventually becomes present almost entirely in the outdoor heat exchanger (23).

In the outdoor heat exchanger (23) of this embodiment, each of the auxiliary heat exchange sections (52*a*-52*c*) is constituted by the same number of the flat tubes (33*b*). Accordingly, during the defrosting, the refrigerant flows into each of the principal heat exchange sections (51*a*-51*c*) of the outdoor heat exchanger (23) at nearly the same flow rate. On the other hand, in the outdoor heat exchanger (23), the number of the flat tubes (33*a*) constituting the first principal heat exchange section (51*a*) is smaller than the number of the flat tubes (33*a*) constituting each of the other principal heat exchange sections (51*b*, 51*c*). Consequently, the flow rate at which the gaseous refrigerant flows through each flat tube (33*a*) of the first principal heat exchange section (51*a*) is greater than the flow rate at which the refrigerant flows through each flat tube (33*a*) of the other principal heat exchange sections (51*b*, 51*c*).

Therefore, force which pushes the liquid refrigerant present in the flat tubes (33*a*) of the first principal heat exchange section (51*a*) toward the second header-collecting pipe (70) becomes strong. As a result, force which pushes and moves the liquid refrigerant present in lowermost ones of the flat tubes (33*a*) of the first principal heat exchange section (51*a*) and in the bottom portion of the upper space (61) of the first header-collecting pipe (60) toward the second header-collecting pipe (70) becomes strong, thereby accelerating discharge of the liquid refrigerant from the lower portion of the first principal heat exchange section (51*a*).

Thus, according to this embodiment, in a manner similar to Embodiment 1, it is possible to shorten the time required to defrost the portion where frost would be allowed to remain according to the conventional techniques (i.e., the lower portion of the first principal heat exchange section (51*a*) that is the lowermost principal heat exchange section). As a result, the time required to defrost the entire outdoor heat exchanger (23) can be shortened.

<<Embodiment 3>>

Embodiment 3 of the present invention is described next. The outdoor heat exchanger (23) of this embodiment is different from the outdoor heat exchanger (23) of Embodiment 2 in the number of the flat tubes (33*a*) of the principal heat exchange sections (51*a*-51*c*) and the structure of the discharge accelerator (100). Hereinafter, the differences between the outdoor heat exchanger (23) of this embodiment and that of Embodiment 2 are described.

In the outdoor heat exchanger (23) of this embodiment, the first principal heat exchange section (51*a*) is constituted by 24 pieces of the flat tubes (33*a*), the second principal heat exchange section (51*b*) is constituted by 22 pieces of the flat tubes (33*a*), and the third principal heat exchange section (51*c*) is constituted by 24 pieces of the flat tubes (33*a*). In a manner similar to the outdoor heat exchanger (23) of Embodiment 2, each of the auxiliary heat exchange sections (52*a*-52*c*) is constituted by three pieces of the flat tubes (33*b*).

Figure 11:
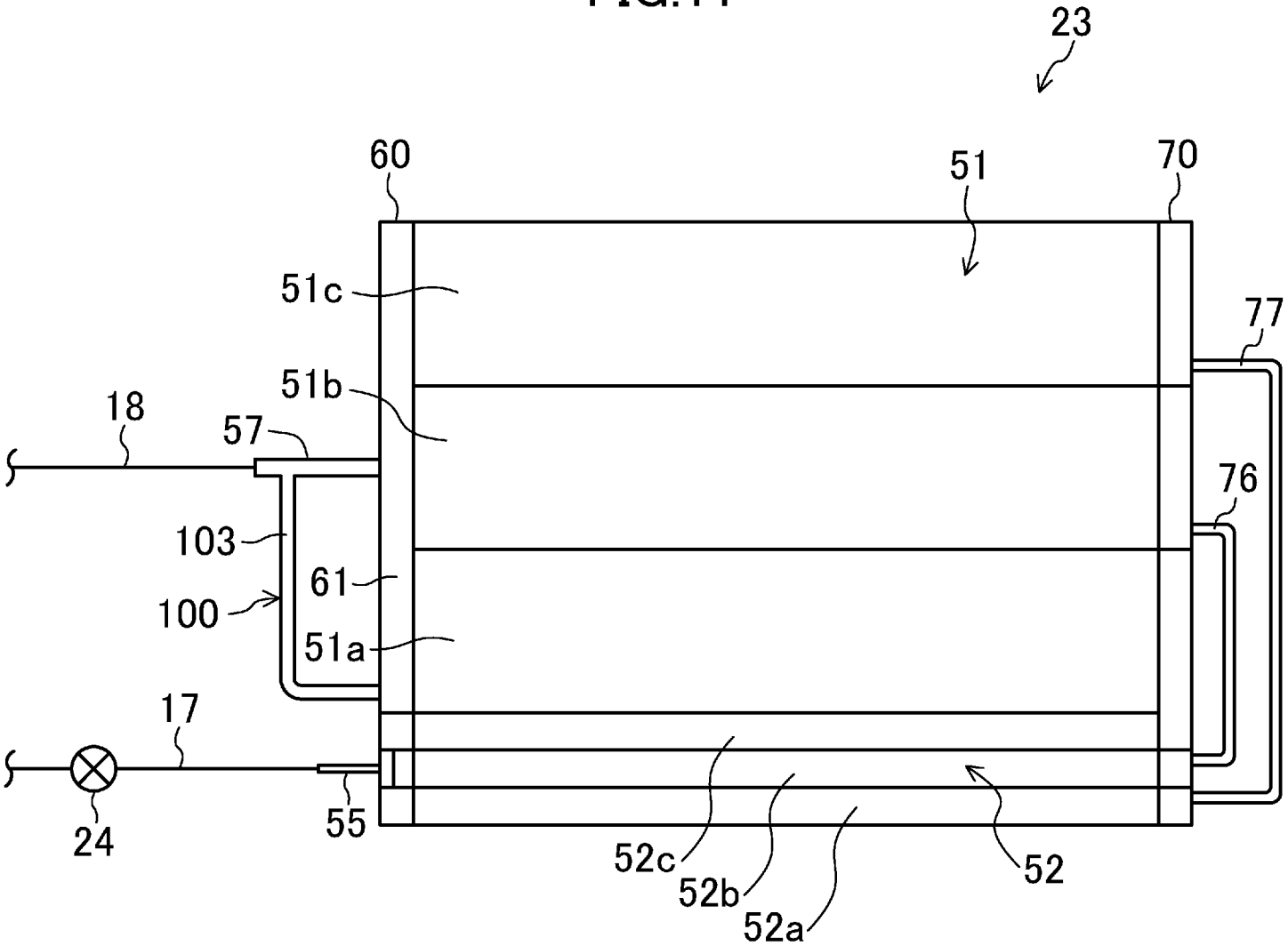
FIG. 11 is a front view schematically illustrating a configuration of an outdoor heat exchanger of Embodiment 3.

As illustrated in FIG. 11, the outdoor heat exchanger (23) of this embodiment is equipped with an additional member, i.e., an auxiliary gas pipe (103). The auxiliary gas pipe (103) is configured to introduce the gas refrigerant to the bottom portion of the upper space (61) of the first header-collecting pipe (60) during the defrosting, and forms the discharge accelerator (100) which accelerates discharge of the liquid refrigerant from the lower portion of the first principal heat exchange section (51*a*) during the defrosting.

Figure 12:
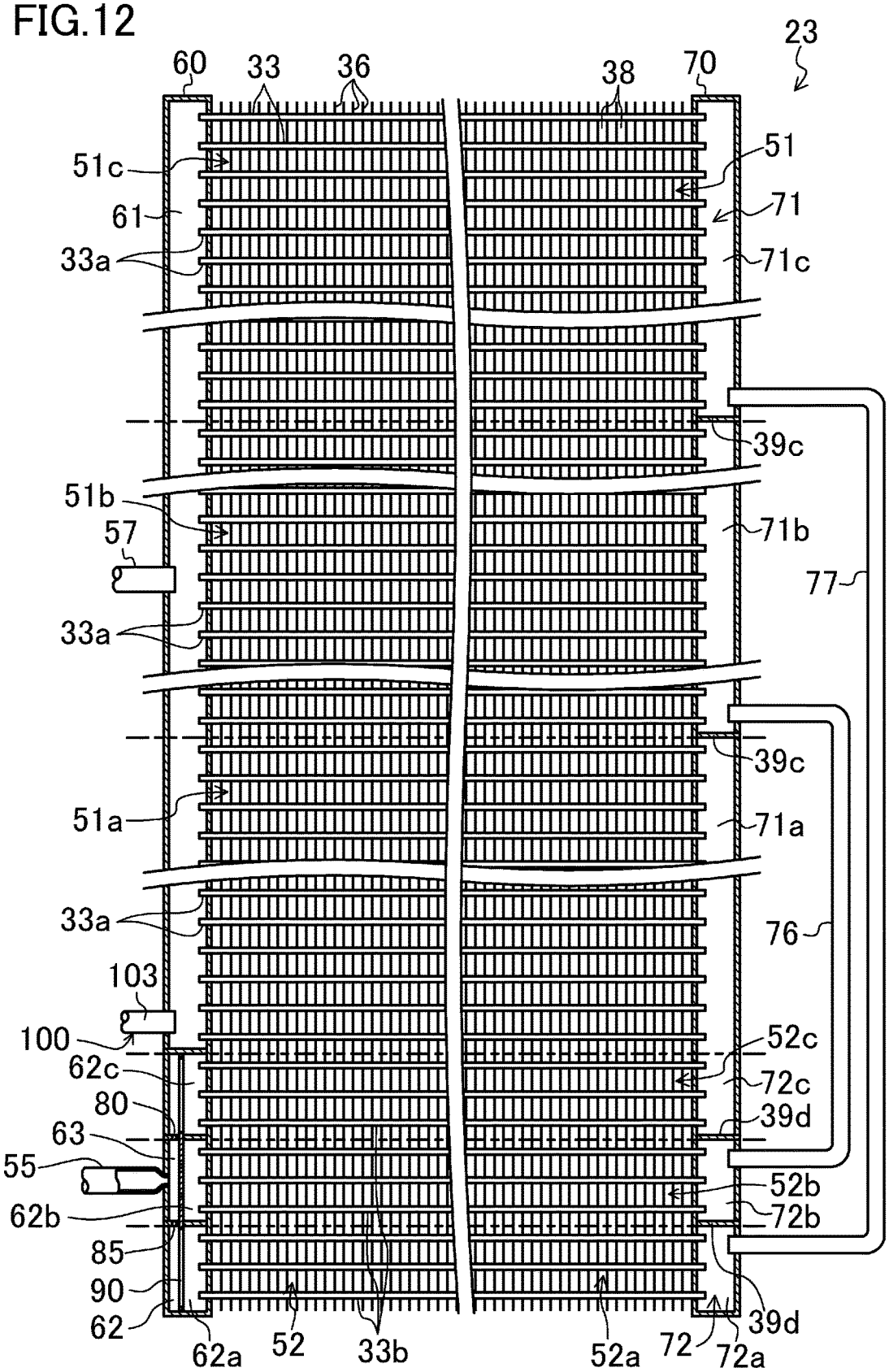
FIG. 12 is a cross-sectional view illustrating a portion of the outdoor heat exchanger of Embodiment 3, viewed from front.

The auxiliary gas pipe (103) has an end connected to the gas connection pipe (57) and the other end connected to the first header-collecting pipe (60). As illustrated in FIG. 12, the latter end of the auxiliary gas pipe (103) opens in the bottom portion of the upper space (61) of the first header-collecting pipe (60) and is opposite to faces end faces of the lowermost ones of the flat tubes (33*a*) of the first principal heat exchange section (51*a*).

When the air conditioner (10) is performing the defrosting operation, in the outdoor heat exchanger (23) of this embodiment, the high-temperature and high-pressure gaseous refrigerant discharged from the compressor (21) is supplied to the upper space (61) of the first header-collecting pipe (60) through both of the gas connection pipe (57) and the auxiliary gas pipe (103). At this moment, the gaseous refrigerant spouts out from the end of the auxiliary gas pipe (103) toward the lowermost ones of the flat tubes (33*a*) of the first principal heat exchange section (51*a*). The liquid refrigerant present in the bottom portion of the upper space (61) flows into the flat tubes (33*a*), together with the gas refrigerant having spouted out from the auxiliary gas pipe (103). The liquid refrigerant present in the fluid passages (34) of the flat tubes (33*a*) communicating with the bottom portion of the upper space (61) (i.e., of the lowermost ones of flat tubes (33*a*) of the first principal heat exchange section (51*a*)) is pushed and moved toward the second header-collecting pipe (70) by the gaseous refrigerant having spouted out from the auxiliary gas pipe (103). Consequently, discharge of the liquid refrigerant from the lower portion of the first principal heat exchange section (51*a*) is accelerated.

Thus, according to this embodiment, in a manner similar to Embodiment 2, it is possible to shorten the time required to defrost the portion where frost would be allowed to remain according to the conventional techniques (i.e., the lower portion of the first principal heat exchange section (51*a*) that is the lowermost principal heat exchange section). As a result, the time required to defrost the entire outdoor heat exchanger (23) can be shortened.

<<Embodiment 4>>

Embodiment 4 of the present invention is described next. The outdoor heat exchanger (23) of this embodiment is different from the outdoor heat exchanger (23) of Embodiment 3 in the structure of the discharge accelerator (100). Hereinafter, the differences between the outdoor heat exchanger (23) of this embodiment and that of Embodiment 3 are described.

Figure 13:
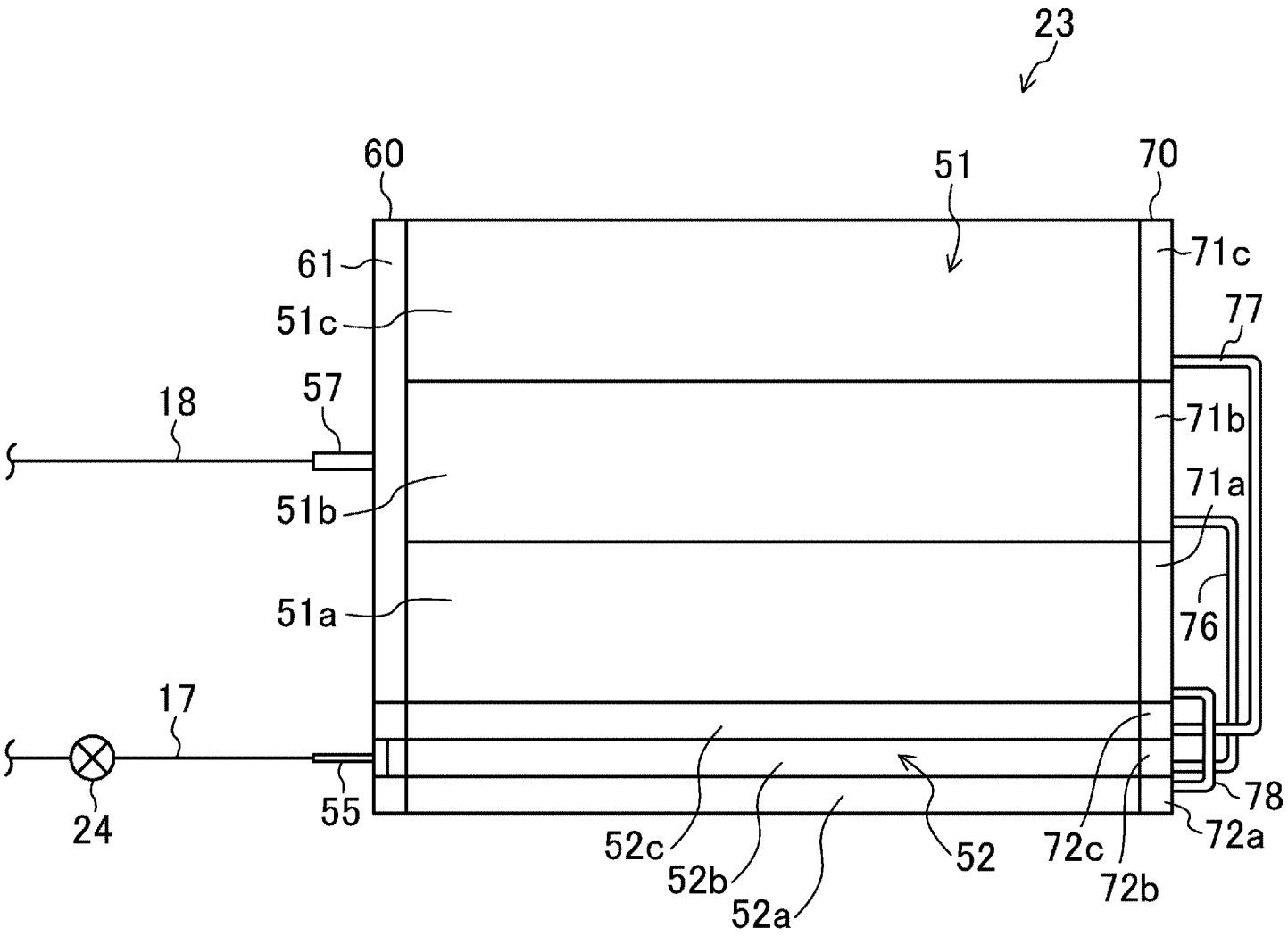
FIG. 13 is a front view schematically illustrating a configuration of an outdoor heat exchanger of Embodiment 4.

As illustrated in FIG. 13, the outdoor heat exchanger (23) of this embodiment is equipped with a third connection pipe (78), instead of the auxiliary gas pipe (103). Further, the position at which the second connection pipe (77) is connected in the outdoor heat exchanger (23) of this embodiment is different from the position at which the second connection pipe (77) is connected in the outdoor heat exchanger (23) of embodiment 3.

In the outdoor heat exchanger (23) of this embodiment, the sixth subspace (72*c*) corresponding to the third auxiliary heat exchange section (52*c*) is separated from the first subspace (71*a*) corresponding to the first principal heat exchange section (51*a*). The second connection pipe (77) has an end connected to the third subspace (71*c*) corresponding to third principal heat exchange section (51*c*), and the other end connected to the sixth subspace (72*c*) corresponding to the third auxiliary heat exchange section (52*c*). The third connection pipe (78) has an end connected to the first subspace (71*a*) corresponding to the first principal heat exchange section (51*a*), and the other end connected to the fourth subspace (72*a*) corresponding the first auxiliary heat exchange section (52*a*).

In the outdoor heat exchanger (23) of this embodiment, the third connection pipe (78) connecting the first principal heat exchange section (51*a*) that is the lowermost heat exchange section of the principal heat exchange section (51*a*-51*c*) to the first auxiliary heat exchange section (52*a*) that is the lowermost heat exchange section of the auxiliary heat exchange sections (52*a*-52*c*) serves as the discharge accelerator (100) which accelerates discharge of the liquid refrigerant from the lower portion of the first principal heat exchange section (51*a*) during the defrosting.

In the outdoor heat exchanger (23) of this embodiment, the first principal heat exchange section (51*a*) that is the lowermost heat exchange section of the principal heat exchange section (51*a*-51*c*) is in connection to the first auxiliary heat exchange section (52*a*) that is the lowermost heat exchange section of the auxiliary heat exchange sections (52*a*-52*c*) through the third connection pipe (78). Accordingly, in the outdoor heat exchanger (23) of this embodiment, the level difference between the first principal heat exchange section (51*a*) and the auxiliary heat exchange section (52*a*) that are in connection to each other is greater than the level difference between the first principal heat exchange section (51*a*) and the third auxiliary heat exchange section (52*c*) that are in connection to each other in the outdoor heat exchanger (23) of Embodiment 3.

Consequently, in the outdoor heat exchanger (23) of this embodiment, it becomes easy to discharge the liquid refrigerant from the first subspace (71*a*) of the second header-collecting pipe (70) corresponding to the first principal heat exchange section (51*a*), and accordingly, the amount of the liquid refrigerant present in the first subspace (71*a*) speedily decreases. As a result, the amount of the liquid refrigerant speedily decreases also in the flat tubes (33*a*) communicating with a bottom portion of the first subspace (71*a*) (i.e., in the lowermost ones of the flat tubes (33*a*) of the first principal heat exchange section (51*a*)) and the bottom portion of the upper space (61) of the first header-collecting pipe (60) communicating with first subspace (71*a*) through the lowermost flat tubes (33*a*). That is, the discharge of the liquid refrigerant from the lower portion of the first principal heat exchange section (51*a*) is accelerated during the defrosting.

Thus, according to this embodiment, in a manner similar to Embodiment 3, it is possible to shorten the time required to defrost the portion where frost would be allowed to remain according to the conventional techniques (i.e., the lower portion of the first principal heat exchange section (51*a*) that is the lowermost principal heat exchange section). As a result, the time required to defrost the entire outdoor heat exchanger (23) can be shortened.

In the outdoor heat exchanger (23) of this embodiment, defrosting of the third auxiliary heat exchange section (52*c*) may be completed before the completion of defrosting of the lowermost portion of the first principal heat exchange section (51*a*) located adjacent to the third auxiliary heat exchange section (52*c*). In this case, the warm gaseous refrigerant is allowed to flow through the flat tubes (33*b*) of the third auxiliary heat exchange section (52*c*). Consequently, heat of this gaseous refrigerant is transferred, by means of thermal conduction, to the lowermost portion of the first principal heat exchange section (51*a*), and it is possible to melt the frost having formed in the lowermost portion of the first principal heat exchange section (51*a*) with the use of the transferred heat. Thus, according to this embodiment, the heat of the gaseous refrigerant flowing through the third auxiliary heat exchange section (52*c*) can also be utilized to defrost first principal heat exchange section (51*a*), which also enables shortening of the time required to defrost the outdoor heat exchanger (23).

<<Embodiment 5>>

Embodiment 5 of the present invention is described next. The outdoor heat exchanger (23) of this embodiment is different from the outdoor heat exchanger (23) of Embodiment 3 in the structure of the discharge accelerator (100). Hereinafter, the differences between the outdoor heat exchanger (23) of this embodiment and that of Embodiment 3 are described.

Figure 14:
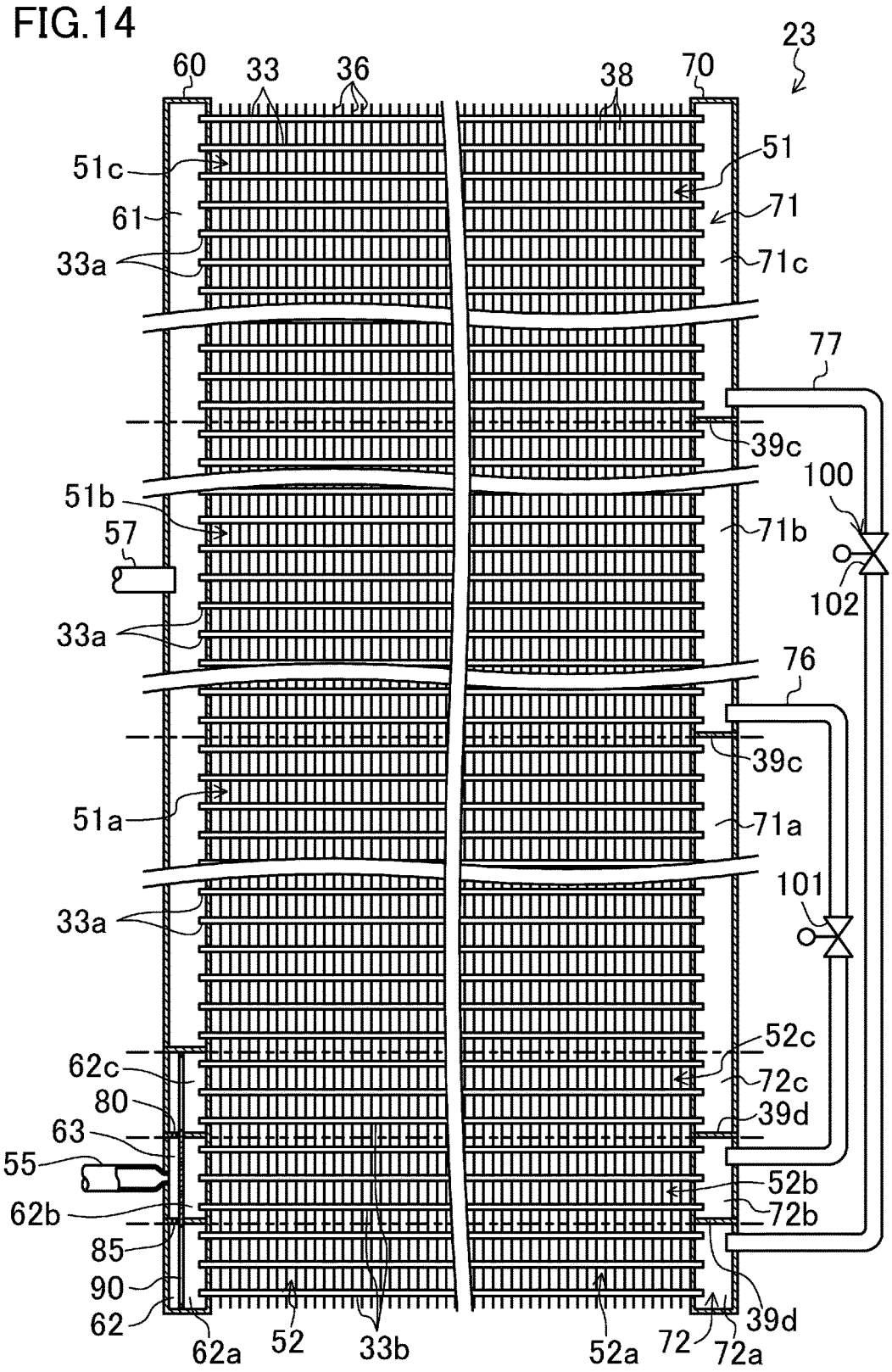
FIG. 14 is a cross-sectional view illustrating a portion of an outdoor heat exchanger of Embodiment 5, viewed from front.

As illustrated in FIG. 14, the outdoor heat exchanger (23) of this embodiment is equipped with a first on-off valve (101) and a second on-off valve (102), instead of the auxiliary gas pipe (103). The first on-off valve (101) is provided on the first connection pipe (76). The second on-off valve is (102) is provided on the second connection pipe (77). The first on-off valve (101) and the second on-off valve (102) are each configured to interrupt and allow communication between a corresponding one of the principal heat exchange section (51*b*, 51*c*) and a corresponding one of the auxiliary heat exchange sections (52*a*, 52*b*), and together form the discharge accelerator (100) which accelerates discharge of the liquid refrigerant from the lower portion of the first principal heat exchange section (51*a*).

When defrosting of the second principal heat exchange section (51*b*) and the third principal heat exchange section (51*c*) is completed before completion of defrosting of the first principal heat exchange section (51*a*), the outdoor heat exchanger (23) of this embodiment enters in a state where almost only the gaseous refrigerant is present in the second principal heat exchange section (51*b*) and the third principal heat exchange section (51*c*) whereas the liquid refrigerant is still allowed to remain in the first principal heat exchange section (51*a*). Under this state, the major portion of the gaseous refrigerant having entered the upper space (61) of the first header-collecting pipe (60) flows into the flat tubes (33*a*) of the second principal heat exchange section (51*b*) and the third principal heat exchange section (51*c*), and a small amount of the gaseous refrigerant flows into the flat tubes (33*a*) of the first principal heat exchange section (51*a*). The small amount of the gaseous refrigerant having entered the flat tubes (33*a*) of the first principal heat exchange section (51*a*) weakens force which pushes and moves the liquid refrigerant present in lowermost ones of the flat tubes (33*a*) of the first principal heat exchange section (51*a*) and the bottom portion of the upper space (61) toward the second header-collecting pipe (70), and thereby increases the time required to defrost the first principal heat exchange section (51*a*).

To address this, when the outdoor heat exchanger (23) of this embodiment has entered this state, either one or both of the first on-off valve (101) and the second on-off valve (102) is closed. Closure of the first on-off valve (101) prevents the gaseous refrigerant from flowing from the upper space (61) to the flat tubes (33*a*) of the second principal heat exchange section (51*b*). Closure of the second on-off valve (102) prevents the gaseous refrigerant from flowing from the upper space (61) to the flat tubes (33*a*) of the third principal heat exchange section (51*c*). Accordingly, closure of either one or both of the first on-off valve (101) and the second on-off valve (102) results in an increase of the flow rate at which the gaseous refrigerant flows into the flat tubes (33*a*) of the first principal heat exchange section (51*a*).

The increase in the flow rate at which the gas refrigerant flows into the flat tubes (33*a*) of the first principal heat exchange section (51*a*) strengthens the force that pushes and moves the liquid refrigerant present in the lowermost ones of the flat tubes (33*a*) of the first principal heat exchange section (51*a*) and the bottom portion of the upper space (61) toward the second header-collecting pipe (70), thereby accelerating discharge of the liquid refrigerant from the lower portion of the first principal heat exchange section (51*a*). Thus, according to this embodiment, in a manner similar to Embodiment 3, it is possible to shorten the time required to defrost the portion where frost would be allowed to remain according to the conventional techniques (i.e., the lower portion of the first principal heat exchange section (51*a*) that is the lowermost principal heat exchange section). As a result, the time required to defrost the entire outdoor heat exchanger (23) can be shortened.

<<Embodiment 6>>

Embodiment 6 of the present invention is described next. The outdoor heat exchanger (23) of this embodiment is different from the outdoor heat exchanger (23) of Embodiment 3 in the structure of the discharge accelerator (100). Hereinafter, the differences between the outdoor heat exchanger (23) of this embodiment and that of Embodiment 3 are described.

Figure 15:
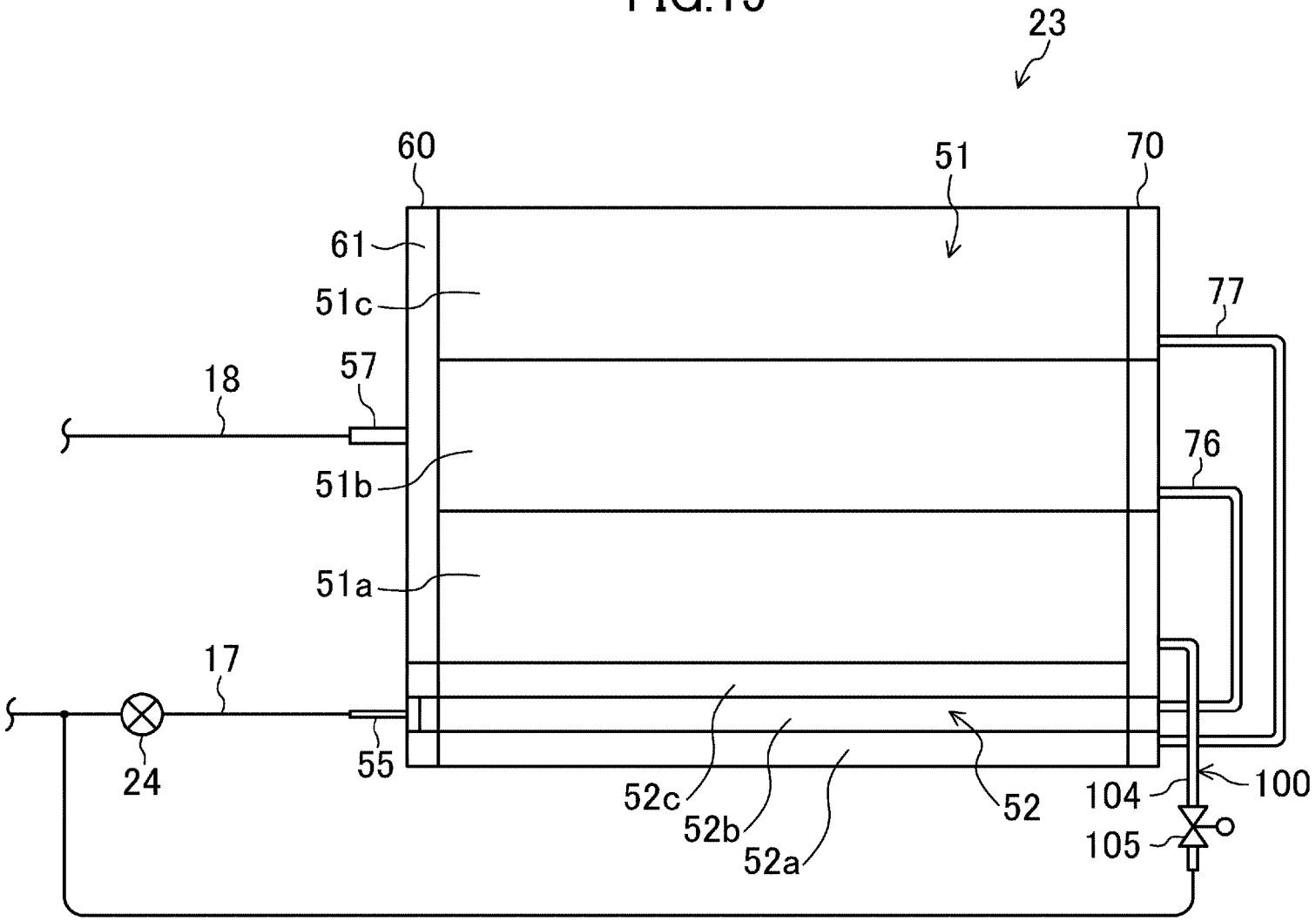
FIG. 15 is a front view schematically illustrating a configuration of an outdoor heat exchanger of Embodiment 6.
Figure 16:
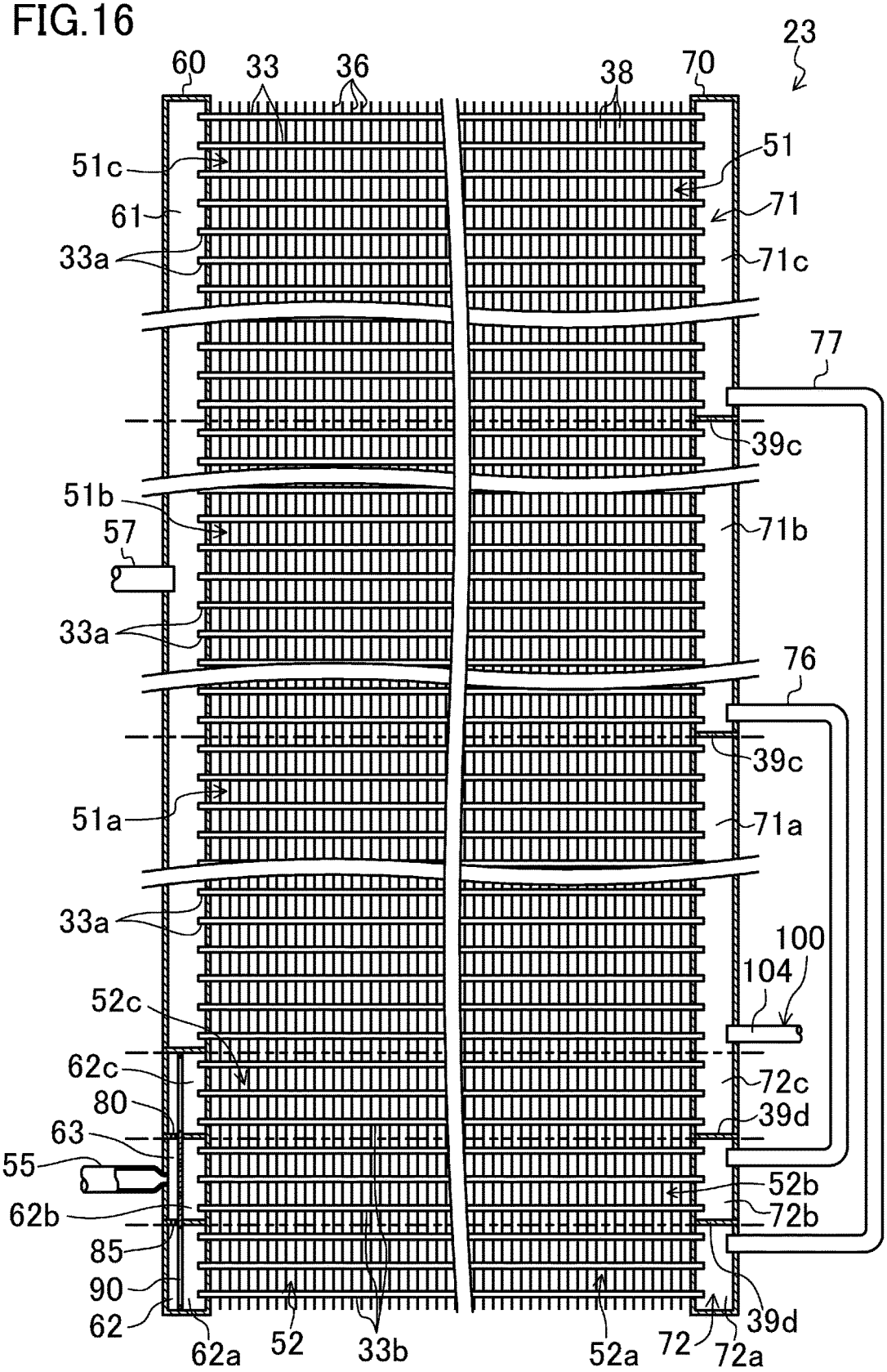
FIG. 16 is a cross-sectional view illustrating a portion of the outdoor heat exchanger of Embodiment 6, viewed from front.

As illustrated in FIG. 15, the outdoor heat exchanger (23) of this embodiment is equipped with a liquid discharge pipe (104), instead of the auxiliary gas pipe (103). The liquid discharge pipe (104) has an end connected to the second header-collecting pipe (70) and the other end connected between the expansion valve (24) and the liquid connection pipe (13) in the refrigerant circuit (20). The liquid discharge pipe (104) is equipped with an on-off valve (105). As illustrated in FIG. 16, the former end of the liquid discharge pipe (104) opens in a bottom portion of the first subspace (71*a*) corresponding to the first principal heat exchange section (51*a*).

The liquid discharge pipe (104) is configured to send the liquid refrigerant present in the bottom portion of the first subspace (71*a*) of the second header-collecting pipe (70) corresponding to the first principal heat exchange section (51*a*) to a low pressure part of the refrigerant circuit (20), and forms the discharge accelerator (100) which accelerates discharge of the liquid refrigerant from the lower portion of the first principal heat exchange section (51*a*) during the defrosting.

When the air conditioner (10) is performing the defrosting operation, the direction in which the refrigerant circulates through the refrigerant circuit (20) is the same as the direction in which the refrigerant circulates when the air conditioner (10) is performing the cooling operation. Accordingly, when the air conditioner (10) is performing the defrosting operation, a side of the refrigerant circuit (20) located downstream of the expansion valve (24) is the low pressure part where the refrigerant having a pressure equivalent to a suction pressure of the compressor (21) flows. When the on-off valve (105) is opened when the air conditioner (10) is performing defrosting operation, the liquid refrigerant present in the first subspace (71*a*) of the second header-collecting pipe (70) is sucked into the liquid discharge pipe (104).

Accordingly, when the outdoor heat exchanger (23) of this embodiment is performing the defrosting, since the liquid refrigerant is sucked from the first subspace (71*a*) of the second header-collecting pipe (70) corresponding to the first principal heat exchange section (51*a*) into the liquid discharge pipe (104), the amount of the liquid refrigerant present in the first subspace (71*a*) speedily decreases. Consequently, the velocity of the liquid refrigerant flowing through the flat tubes (33*a*) communicating with the bottom portion of the first subspace (71*a*) (i.e. through the lowermost ones of the flat tubes (33*a*) of the first principal heat exchange section (51*a*)) increases, and the amount of the liquid refrigerant speedily decreases also in the bottom portion of the upper space (61) of the first header-collecting pipe (60) communicating with the first subspace (71*a*) through the flat tubes (33*a*) of the first principal heat exchange section (51*a*). Thus, discharge of the liquid refrigerant from the bottom portion of the upper space (61) of the first header-collecting pipe (60) is accelerated during the defrosting.

Thus, according to this embodiment, in a manner similar to Embodiment 3, it is possible to shorten the time required to defrost the portion where frost would be allowed to remain according to the conventional techniques (i.e., the lower portion of the first principal heat exchange section (51*a*) that is the lowermost principal heat exchange section). As a result, the time required to defrost the entire outdoor heat exchanger (23) can be shortened.

<<Other Embodiments>>

—First Variation—

Figure 17:
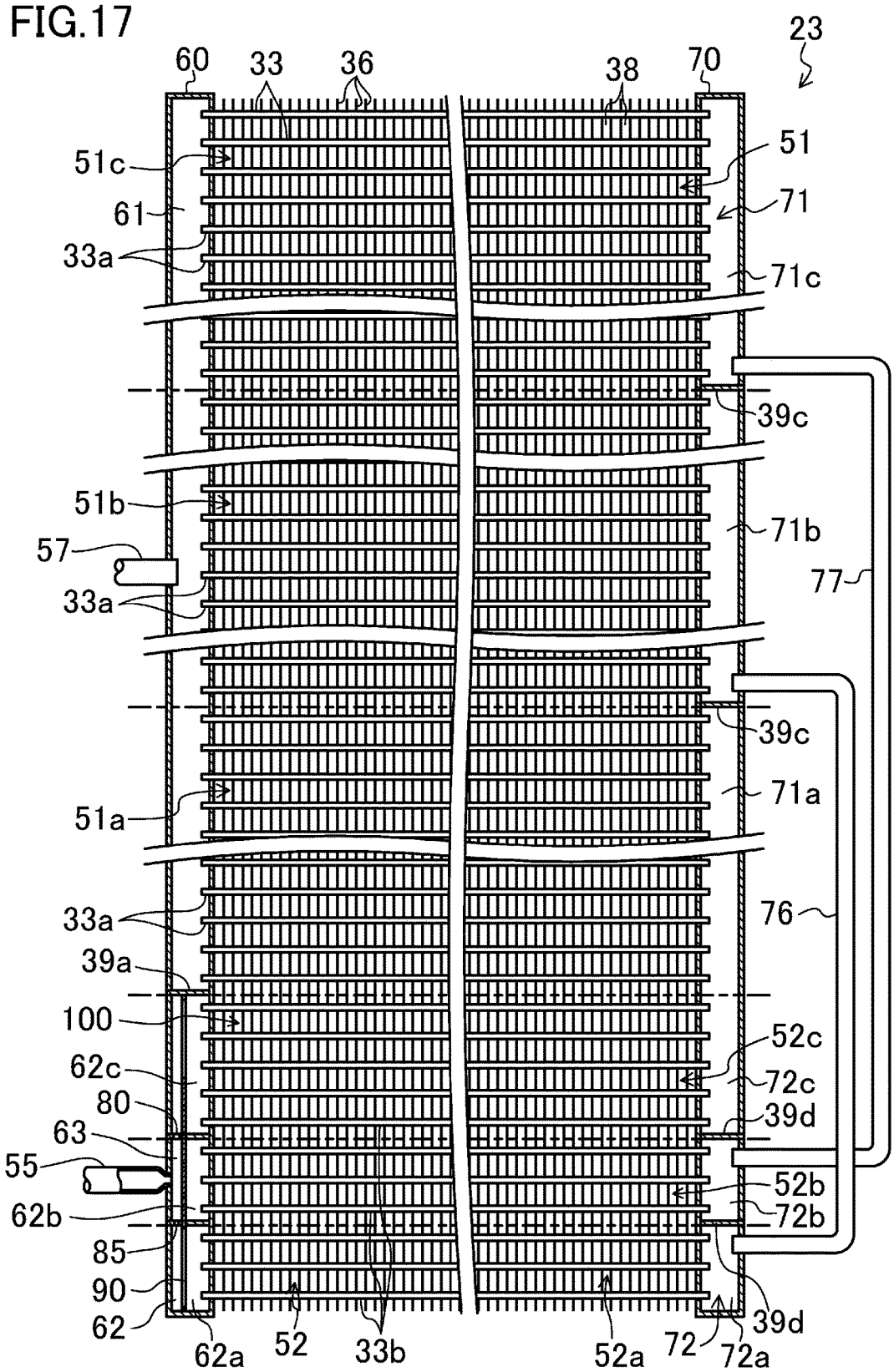
FIG. 17 is a cross-sectional view illustrating a portion of an outdoor heat exchanger of a first variation of other embodiment, viewed from front.
Figure 18:
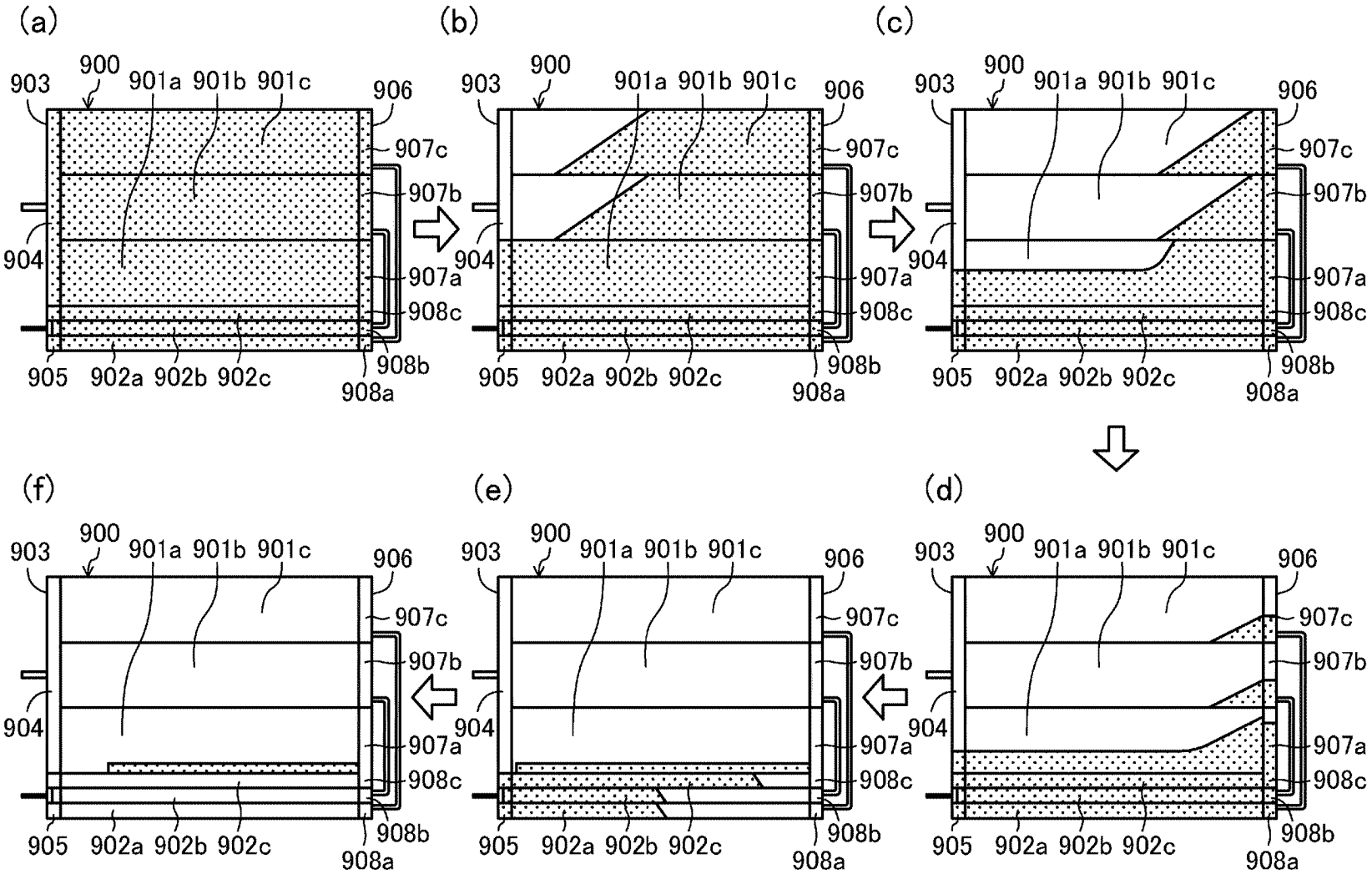
FIG. 18 shows front views of a heat exchanger for illustrating a problem of a conventional technique.

With regard to the outdoor heat exchanger (23) of Embodiments 1-3, 5, and 6, the first connection pipe (76) and the second connection pipe (77) may be connected at positions different from those described above. For example, as illustrated in FIG. 17, the first connection pipe (76) may have an end connected to the second subspace (71*b*) corresponding to the second principal heat exchange section (51*b*), and the other end connected to the fourth subspace (72*a*) corresponding to the first auxiliary heat exchange section (52*a*). The second connection pipe (77) may have an end connected to the third subspace (71*c*) corresponding to the third principal heat exchange section (51*c*), and the other end connected to the fifth subspace (72*b*) corresponding to the second auxiliary heat exchange section (52*b*). FIG. 17 illustrates the outdoor heat exchanger (23) of Embodiment 1 into which this variation is adopted.

—Second Variation—

In each of the foregoing embodiments, a single heat exchanger serves as the outdoor heat exchanger (23) and is divided into the principal heat exchange region (51) and the auxiliary heat exchange region (52). The outdoor heat exchanger (23), however, may be constituted by two or more separate heat exchangers.

Specifically, the outdoor heat exchanger (23) may be constituted by a heat exchanger serving as the principal heat exchange region (51) and a heat exchanger serving as the auxiliary heat exchange region (52). If this is the case, the heat exchanger serving as the principal heat exchange region (51) is divided into a plurality of principal heat exchange sections (51*a*-51*c*). The heat exchanger serving as the auxiliary heat exchange region (52) is divided into the same number of auxiliary heat exchange sections (52*a*-52*c*) as the number of the principal heat exchange sections (51*a*-51*c*).

—Third Variation—

In the outdoor heat exchanger (23) of each of the foregoing embodiments, corrugated fins may be provided instead of the flat plate-shaped fins (36). The fins of this variation are so-called corrugated fines formed in a corrugated shape which vertically meanders. Each of the corrugated fins is placed between adjacent ones of the flat tubes (33) located one above the other.

INDUSTRIAL APPLICABILITY

As described above, the present invention is useful for heat exchangers including flat tubes and header-collecting pipes and configured to cause a refrigerant to exchange heat with air.

DESCRIPTION OF REFERENCE CHARACTERS

20 Refrigerant circuit
23 Outdoor heat exchanger
33 Flat tubes
36 Fins
51*a* First heat exchange section
51*b* Second heat exchange section
51*c* Third heat exchange section
52*a* First auxiliary heat exchange section
52*b* Second auxiliary heat exchange section
52*c* Third auxiliary heat exchange section
60 First header-collecting pipe
61 Upper space (Communicating space)
70 Second header-collecting pipe
71*a* First subspace
71*b* Second subspace
71*c* Third subspace
100 Discharge accelerator

The invention claimed is:

1. A heat exchanger comprising:

a plurality of flat tubes; a first header-collecting pipe connected to an end of each of the flat tubes; a second header-collecting pipe connected to the other end of each of the flat tubes; and a plurality of fins joined to the flat tubes, the heat exchanger provided in a refrigerant circuit which is configured to perform a refrigerating cycle, and causing a refrigerant to exchange heat with air, wherein the first header-collecting pipe and the second header-collecting pipe are in an upright position, a plurality of heat exchange sections each of which is constituted by adjacent flat tubes are arranged one above the other, the first header-collecting pipe includes therein one communicating space which communicates with the flat tubes of all of the heat exchange sections, the second header-collecting pipe includes therein subspaces, each of the subspaces corresponding to a different one of the heat exchange sections, each of the subspaces communicating with the flat tubes constituting the corresponding one of the heat exchange sections, the heat exchanger further includes a discharge accelerator which accelerates discharge of the refrigerant in a liquid state from a lower portion of the heat exchange section which is the lowermost heat exchange section during defrosting in which the refrigerant in a high-pressure gas state is introduced from the communicating space to the flat tubes in order to melt frost having formed on the fins, the flat tubes constitute auxiliary heat exchange sections, each of the auxiliary heat exchange sections corresponding to a different one of the heat exchange sections, the flat tubes constituting the auxiliary heat exchange sections are smaller in number than the flat tubes constituting the heat exchange sections, the auxiliary heat exchange sections are each in series connection to the corresponding one of the heat exchange sections, tube number ratios are obtained by dividing the number of the flat tubes constituting each of the heat exchange sections by the number of the flat tubes constituting a corresponding one of the auxiliary heat exchange sections, the tube number ratio of the heat exchange section that is the lowermost heat exchange section is smaller than the tube number ratio of each of the other heat exchange sections located above the lowermost heat exchange section, and the heat exchange section that is the lowermost heat exchange section and the auxiliary heat exchange section corresponding to the heat exchange section form the discharge accelerator.

2. The heat exchanger of claim 1, wherein all of the auxiliary heat exchange sections are located below all of the heat exchange sections.

3. The heat exchanger of claim 2, wherein the auxiliary heat exchange section corresponding to the heat exchange section that is the lowermost heat exchange section is the uppermost located one of all of the auxiliary heat exchange sections.

4. A heat exchanger comprising:

a plurality of flat tubes; a first header-collecting pipe connected to an end of each of the flat tubes; a second header-collecting pipe connected to the other end of each of the flat tubes; and a plurality of fins joined to the flat tubes, the heat exchanger provided in a refrigerant circuit which is configured to perform a refrigerating cycle, and causing a refrigerant to exchange heat with air, wherein the first header-collecting pipe and the second header-collecting pipe are in an upright position, a plurality of heat exchange sections each of which is constituted by adjacent flat tubes are arranged one above the other, the first header-collecting pipe includes therein one communicating space which communicates with the flat tubes of all of the heat exchange sections, the second header-collecting pipe includes therein subspaces, each of the subspaces corresponding to a different one of the heat exchange sections, each of the subspaces communicating with the flat tubes constituting the corresponding one of the heat exchange sections, the heat exchanger further includes a discharge accelerator which accelerates discharge of the refrigerant in a liquid state from a lower portion of the heat exchange section which is the lowermost heat exchange section during defrosting in which the refrigerant in a high-pressure gas state is introduced from the communicating space to the flat tubes in order to melt frost having formed on the fins, the flat tubes constitute auxiliary heat exchange sections, each of the auxiliary heat exchange sections corresponding to a different one of the heat exchange sections, the flat tubes constituting the auxiliary heat exchange sections are smaller in number than the flat tubes constituting the heat exchange sections, the auxiliary heat exchange sections are each in series connection to the corresponding one of the heat exchange sections, tube number ratios are obtained by dividing the number of the flat tubes constituting each of the heat exchange sections by the number of the flat tubes constituting a corresponding one of the auxiliary heat exchange sections, the tube number ratio of the heat exchange section that is the lowermost heat exchange section is smallest of the tube number ratios, the heat exchange section that is the lowermost heat exchange section and the auxiliary heat exchange section corresponding to the heat exchange section form the discharge accelerator, and the number of the flat tubes constituting the auxiliary heat exchange section corresponding to the heat exchange section that is the lowermost heat exchange section is largest of the numbers of the flat tubes constituting the auxiliary heat exchange sections.

5. The heat exchanger of claim 4, wherein all of the auxiliary heat exchange sections are located below all of the heat exchange sections.

6. The heat exchanger of claim 5, wherein the auxiliary heat exchange section corresponding to the heat exchange section that is the lowermost heat exchange section is the uppermost located one of all of the auxiliary heat exchange sections.

* * * * *